US007867102B2

(12) United States Patent
Wallace

(10) Patent No.: US 7,867,102 B2
(45) Date of Patent: Jan. 11, 2011

(54) GOLF SWING TRAINING AND EXERCISE SYSTEM, DEVICE AND KIT

(76) Inventor: Donald John Wallace, 36 Chivalry La., Nesconset, NY (US) 11767

( * ) Notice: Subject to any disclaimer, the term of this patent is extended or adjusted under 35 U.S.C. 154(b) by 0 days.

(21) Appl. No.: 12/383,444

(22) Filed: Mar. 24, 2009

(65) Prior Publication Data

US 2009/0239675 A1 Sep. 24, 2009

Related U.S. Application Data

(60) Provisional application No. 61/038,991, filed on Mar. 24, 2008.

(51) Int. Cl.
*A63B 69/36* (2006.01)
*A63B 26/00* (2006.01)

(52) U.S. Cl. ..... 473/220; 473/257; 482/140

(58) Field of Classification Search ..... 473/207–209, 473/212, 219–225, 257, 266, 267, 274, 276, 473/278; 482/34, 106, 107, 124, 140, 148
See application file for complete search history.

(56) References Cited

U.S. PATENT DOCUMENTS 4,770,414 A * 9/1988 Fredrickson et al. ..... 482/148
5,190,512 A * 3/1993 Curran ..... 482/124
5,269,528 A * 12/1993 McCardle, Jr. ..... 473/409
6,386,988 B1 * 5/2002 Shearer et al. ..... 473/220
7,090,627 B1 * 8/2006 Walker ..... 482/140

* cited by examiner

*Primary Examiner*—Nini Legesse
(74) *Attorney, Agent, or Firm*—Adams & Wilks

(57) ABSTRACT

A golf swing training and exercise system includes an optically reflective device, a golf device, a pair of light source devices, and a resistance device. The golf device has a center section that is placed on the back of a user during a golf swing training and exercise routine, two end sections extending outwardly from the center section, and a pair of intermediate sections that are disposed between and interconnect the center section and the respective end sections to one another and on which the user's hands or forearms are placed during the golf swing training and exercise routine. The light source devices are connected to respective distal ends of the end sections for projecting light beams on a reflective surface of the optically reflective device during a golf swing training and exercise routine. The resistance device is removably connected to the golf device to apply a resistance in at least one direction of movement of the golf device during the golf swing training and exercise routine.

22 Claims, 27 Drawing Sheets

GOLF SWING TRAINING AND EXERCISE SYSTEM, DEVICE AND KIT

CROSS-REFERENCE TO RELATED APPLICATIONS

The present Application for Patent claims priority benefit of Provisional Application Ser. No. 61/038,991, filed Mar. 24, 2008. This provisional patent application is hereby expressly incorporated by reference herein.

BACKGROUND OF THE INVENTION

I. Field of the Invention

The present invention relates generally to sport and sporting goods and, more specifically, to a golf swing training and exercise system and device for improving the golf swing mechanics of a user and for strengthening the user's golf swing. The present invention also relates to a golf swing training and exercise kit.

II. Background Information

The game of golf is an exact and mentally demanding sport. The physical requirements of the game require a high level of precision and expertise, especially if a golfer desires to excel. Many variables enter into the mechanics of a proper golf swing. A proper golf swing requires proper dynamic positioning of the hands, the arms, the legs, the torso, the head, and the feet. Other variables are introduced in the dynamic positioning of the muscles which control the body. It takes much precise positioning and practice to achieve the most desirable and consistent golf swing.

Golf is also a popular pastime, with a long history of training aids and devices for improving the skills of the golfer, on or away from the golf course. Many of these devices attempt to train the swing of the golfer by helping the golfer to modify and improve the swing.

Training aids designed to assist golfers in developing a proper golf swing have included arm braces, gloves, tubular tracks and many other devices. For example, existing golf paraphernalia include devices to improve the grip of the golfer by preventing the wrist of the golfer from moving to a position other than what is pre-set by the device. Special gloves also exist to direct the golfer to place his or her hands on the shaft of the golf club correctly. However, while the aforesaid devices are useful in teaching a golfer the proper swing plane of a golf club, they do not provide the golfer with any feedback regarding the angular orientation of a club head during the swing. Specifically, while the aforesaid devices may teach a golfer how to swing the club on plane, they do not tell the golfer whether or not the club head would be square to the ball at impact which is necessary to execute a straight shot.

Other devices have also been proposed to help train the muscles of the golfer to move along a pre-determined path which is thought to be along an optimal golf swing path. These devices restrict the swing path of the golfer to a plane within which it is thought necessary to maintain the golf club throughout the golf swing. However, no resistance is supplied in the direction of rotation of the shoulders and upper torso, or the hips, of the golfer during performance of an exercise using an external device of this type. Further, these devices fail to train the golfer to progressively accelerate the golf club during the downswing.

In summary, existing golf devices either attach to the hands, wrists or other parts of the body of a golfer, or are held by the golfer, only to either train parts of the body of the golfer to maintain a correct orientation, restrain the golf swing of the golfer to a correct swing path, or train the golfer to accelerate at the proper point of the downswing. None of these devices actually provides resistance to optimally strengthen the muscles of the axial skeleton and lower extremities of the golfer which participate in the golf swing, while providing training to the golfer to accelerate properly and to maintain a proper orientation during the golf swing.

SUMMARY OF THE INVENTION

It is therefore an object of the present invention to provide a golf swing training and exercise system and device which allow a user to develop a proper golf swing by allowing the user to visualize the mechanics of a proper golf swing through the use of the system and device.

It is another object of the present invention to provide a golf swing training and exercise device which strengthens and coordinates and facilitates use of the muscles during a golf swing efficiently while increasing balance and propioception.

It is another object of the present invention to provide a golf swing training and exercise system that includes a resistance such that during an exercise simulating a golf swing, the core, hip and lower extremity muscles of a golfer are strengthened, and proper swing dynamics are instilled.

It is a further object of the present invention to provide a golf swing training and exercise system and device which provides a visual representation of a swing path to assist the golfer in perfecting his or her swing.

It is another object of the present invention to provide a golf swing training exercise system and device which assists the golfer in removing use of the hands and wrists during a swing and activates the core and leg and hip muscle as a primary muscle used during a golf swing.

It is still another object of the present invention to provide a golf swing training and exercise system and device which is self-acting, portable and suitable for golfers of all sizes, ages, right-handed or left-handed, and both genders.

It is yet another object of the present invention to provide a golf swing training and exercise system and device which is rugged, economical to manufacture, and simple to use both indoors and outdoors.

The foregoing and other objects of the present invention are carried out by a golf swing training and exercise system including an optically reflective member having an optically reflective surface, and a golf device having a plurality of sections comprised of a center section that is placed on the back of a user during a golf swing training and exercise routine, two end sections extending outwardly from the center section, and a pair of intermediate sections that are disposed between and interconnect the center section and the respective end sections to one another and on which the user's hands or forearms are placed during a golf swing training and exercise routine. A pair of light source devices is connected to respective distal ends of the end sections to project respective light beams on the reflective surface of the optically reflective member during a golf swing training and exercise routine. A resistance device is connected to the golf device to generate resistance in at least one direction of movement of the golf device during a golf swing training and exercise routine.

In another aspect, the present invention provides a golf swing training and exercise device that includes a golf device having a plurality of sections comprised of a center section that is placed on the back of a user during a golf swing training and exercise routine, two end sections extending from respective opposite ends of the center section, and a pair of intermediate sections that are disposed between and interconnect the center section and the respective end sections and on which the user's hands or forearms are placed during a golf swing training and exercise routine. A pair of light source devices is connected to respective distal ends of the end sections to project respective light beams on a reflective surface during a golf swing training and exercise routine.

In yet another aspect, the present invention provides a golf swing training and exercise kit including a sheet or layer of a laser light reflective material, a plurality separate and independent sections including a pair of side sections and a center section for removable connection between the side sections to form a golf swing training and exercise device that is used by a golfer during a golf swing training and exercise routine by placing the golfer's hands or forearms on the respective side sections and placing the center section in contact with the golfer's upper back, a pair of laser devices mounted on the golf swing training and exercise device to project laser light onto the sheet or layer of laser light reflective material by movement of the golf swing training and exercise device during the golf swing training and exercise routine, and a resistance application device that is removably connected to the golf swing training and exercise device to apply a resistance in the direction of movement of the golf swing training and exercise device during the golf swing training and exercise routine.

According to other features of the present invention, each laser device has a time control circuit which, upon activation, automatically switches the laser device from an ON state to an OFF state after a preselected period of time from the time of activation. Each laser may also comprise a green laser diode. The film of laser light reflective material preferably comprises a generally linear strip of laser light reflective material.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
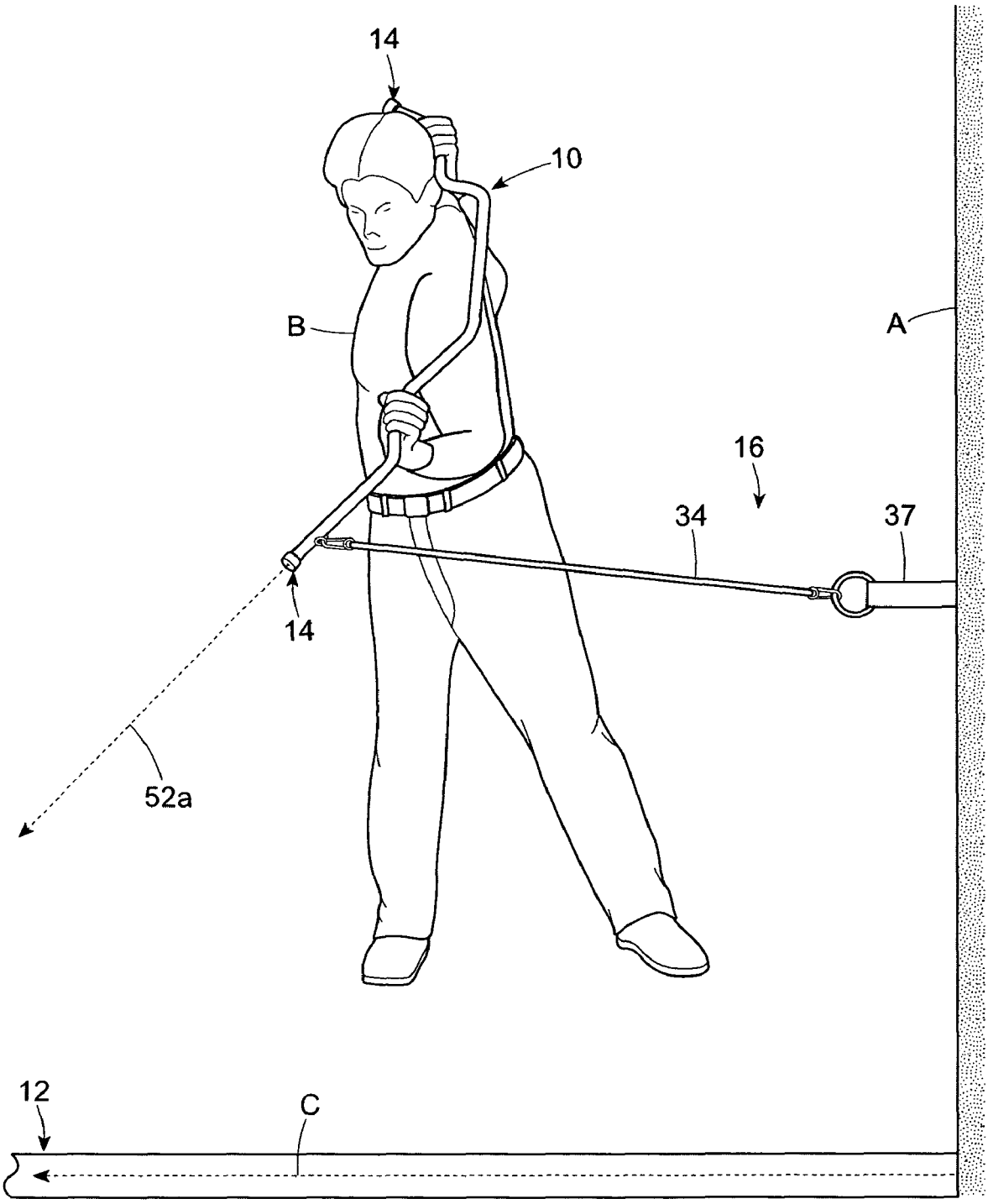
FIG. 1 is a front perspective view of a golfer utilizing the golf swing training and exercise system according to an embodiment of the present invention.

While this invention is susceptible of embodiments in many different forms, this specification and the accompanying drawings disclose some examples of the use of the invention. The invention is not intended to be limited to the embodiments so described, and the scope of the invention will be pointed out in the appended claims.

Referring now to the drawings in detail, wherein like numerals are used to indicate like elements throughout, there is shown in FIGS. 1 to 7 an embodiment of a golf swing training and exercise system according to the present invention. The golf swing training and exercise system generally includes a golf swing training and exercise device generally designated at 10 (hereinafter "the golf device"), an optically reflective device generally designated at 12, a pair of light sources generally designated at 14 mounted on the golf device 10, and a resistance device generally designated at 16 connected between the golf device 12 and a fixed structure A.

Figure 2:
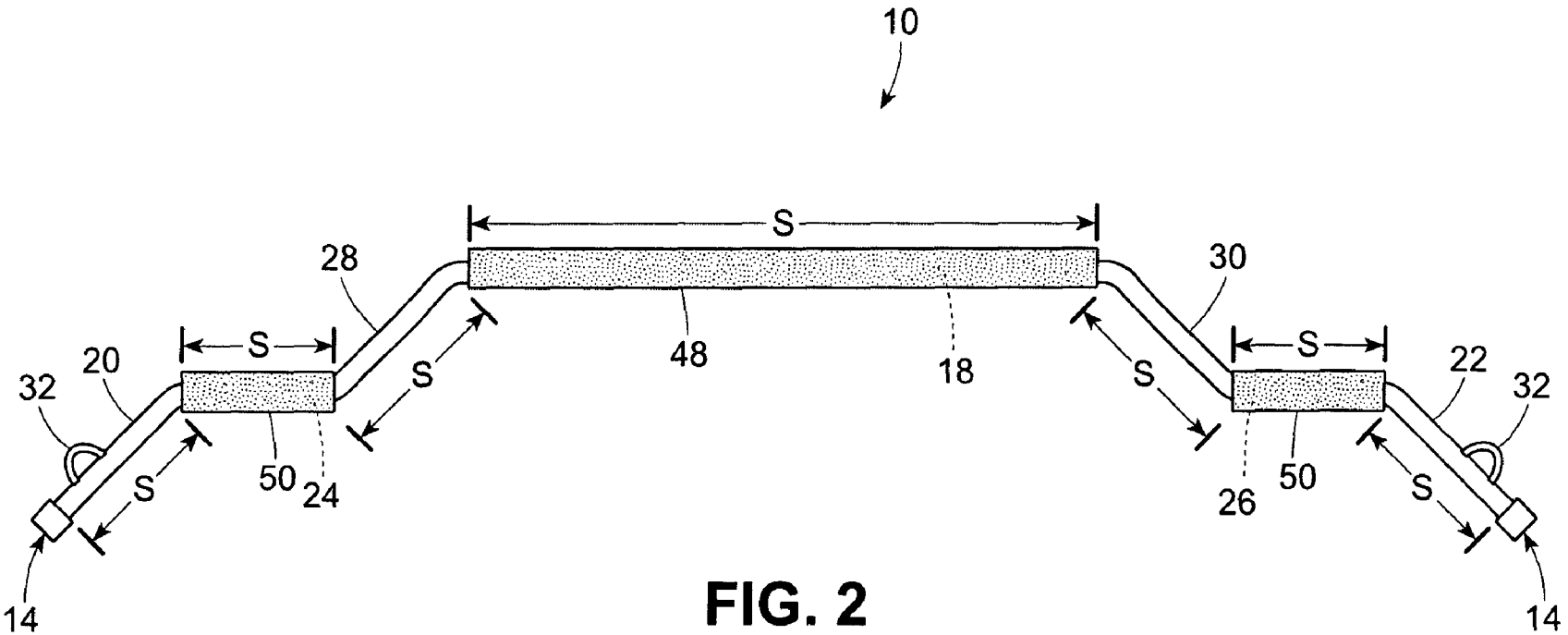
FIG. 2 is a side view of an embodiment of a golf swing training and exercise device for the golf swing training and exercise system according to the present invention.
Figure 3:
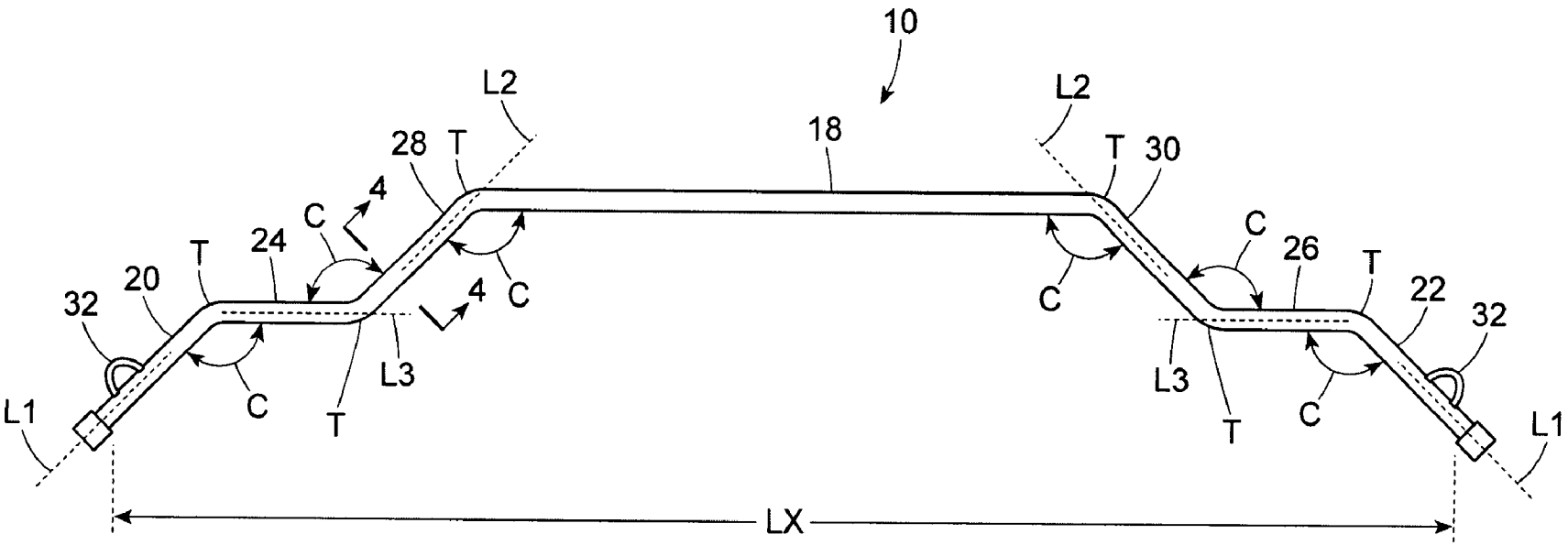
FIG. 3 is a side view of the golf swing training and exercise device shown in FIG. 2 with the cushion member and grip members removed.
Figure 4:
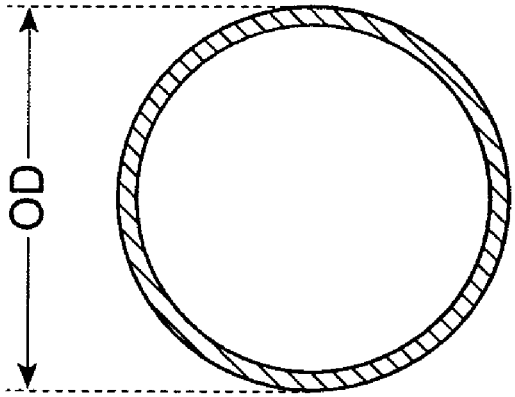
FIG. 4 is a cross-sectional view taken in the direction of line 4-4 in FIG. 3 and depicts an example of the cross-sectional shape of the sections forming the golf swing training and exercise device.

Referring to FIGS. 2-4, in one embodiment the golf device 10 is of unitary construction with multiple sections formed as a single piece. This single piece construction includes a center section 18, two end sections 20, 22 extending outwardly from the center section 18, a first pair of intermediate sections 24, 26 extending from the respective end sections 20, 22, and a second pair of intermediate sections 28, 30 extending from and interposed between the center section 18 and the respective first pair of intermediate sections 24, 26. During a golf swing training and exercise routine, the user's hands are placed on the respective intermediate sections 24, 26 and the center section 18 is placed on the user's upper back such as, for example, in the manner shown in FIG. 1. In the embodiments described herein, the user's hands grip the respective intermediate sections 24, 26 during a golf swing training and exercise routine. However, it is understood that the training and exercise routine, and specifically the exercises in the program further described below, can be performed with equal accuracy and efficiency while the user's forearms, or the palms of the user's open hands, are placed on the respective intermediate sections 24, 26.

Longitudinal axes L1 of the end sections 20, 22 are generally parallel to respective longitudinal axes L2 of the second intermediate sections 28, 30. The longitudinal axes of the first intermediate sections 24, 26 are generally collinear relative one another. The second pair of intermediate sections 28, 30 are contiguous with and extend at an angle C to respective proximal ends of the central section 18, the first pair of intermediate sections 24, 26 are contiguous with and extend at an angle C to respective proximal ends of the second pair of intermediate sections 28, 30, and the end sections 20, 22 are contiguous with and extend at an angle C to respective proximal ends of the first pair of intermediate sections 24, 26. The foregoing sections of the golf device 10 extend from each other as described above at respective junctions or transition locations T. Preferably, the angle C is selected to be in the range of about 20 to 60 degrees, and more preferably about 45 degrees.

Figure 8:
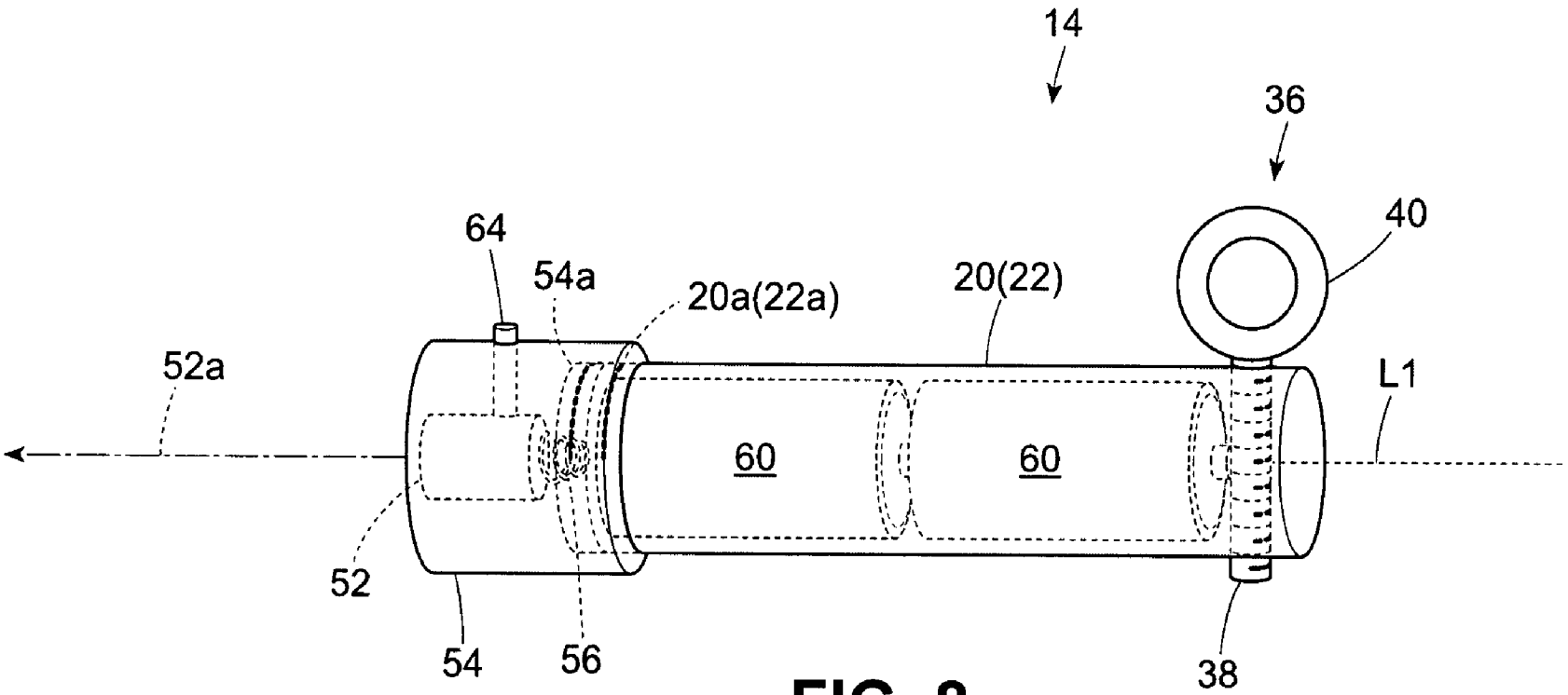
FIG. 8 is a side view of another embodiment of the light source device for the golf swing training and exercise device according to the present invention.

The golf device 10 has a pair of connectors 32 integral with the respective end sections 20, 22 and to which an end of an elastic resistance band 34 of the resistance device 16 is selectively removably attached. As further described below, the elastic resistance band 34 is connected to a strap member 37 of the resistance device 16, and the strap member 37 is in turn integrally connected to the fixed structure A as shown in FIG. 1. In this embodiment, the connectors 32 are generally U-shaped and integrally connected to the end sections 20, 22 by welding, such as by a fillet weld or spot weld. However, it is understood by those skilled in the art that other forms of connection between the connectors 32 and the end sections 20, 22 are suitable, including the use of adhesives, strap connections, and/or fasteners. Alternatively, as shown in FIG. 8 further described below, each connector 32 may be in the form of a metallic fastener generally designated at 36 and having a threaded shank 38 that is threaded into the corresponding end section 20, 22 and a generally circular-shaped eyelet 40 that extends from an exterior surface of the corresponding end section and to which the end of the elastic resistance band 34 can be selectively removably attached. It is also appreciated that the golf device 10 does not require two connectors 32 for performing a golf swing training and exercise routine, and only one connector 32 on either of the end sections 20, 22 is sufficient. However, the provision of two connectors 32 as described herein will increase the number of exercises and routines that can be formed by the golf device 10.

In a preferred embodiment, the golf device 10, excluding the light sources 14, has a length Lx in the range of about 24 to 96 inches. More preferably, the length Lx of the golf device 10 is about 48 inches, with the end sections and the first and second intermediate sections each having a length S of about 6 inches and the center section having a length S of about 12 inches. The length Lx is selected to be suitable for comfortable arms-width gripping by the user.

Figure 6:
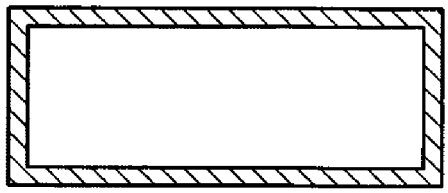
FIG. 6 is a cross-sectional view showing yet another example of the cross-sectional shape of the sections forming the golf swing training and exercise device.
Figure 5:
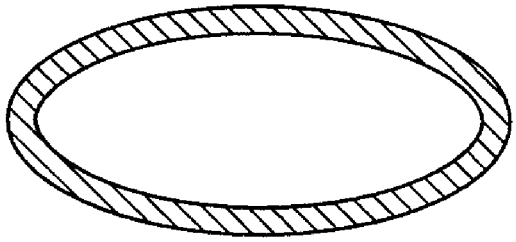
FIG. 5 is a cross-sectional view showing another example of the cross-sectional shape of the sections forming the golf swing training and exercise device.

As shown in FIG. 4, the sections of the golf device 10 have a hollow circular tubing construction with an outer diameter OD preferably in the range of about 0.25 inches to 2.00 inches, and more preferably about 1.125 inches. However, other constructions and configurations are suitable for the sections of the golf device 10. For example, the sections of the golf device 10 may have a cross-sectional shape other than circular, such as oval or square as shown in FIGS. 5 and 6, respectively. Further, instead of a hollow member, the sections of the golf device 10 may be formed as solid bars having any of the cross-sections shown in FIGS. 4-6 or any other suitable cross-section. Still further, while the configuration of the golf device 10 shown includes six angles C each of about 45 degrees, other configurations such as a completely straight configuration with 0 degrees to bends up to 90 degrees are suitable. Alternatively, the golf device 10 can have one large bend instead of multiple sections.

Figure 23:
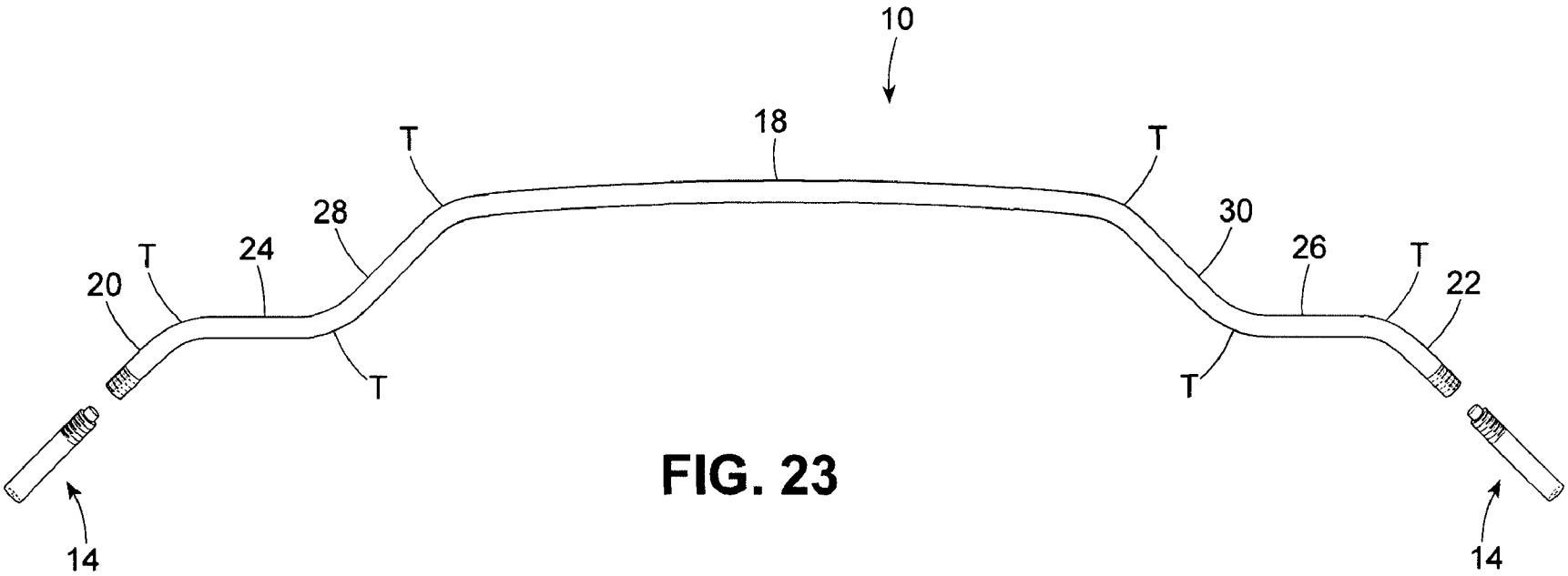
FIG. 23 is a side view of another embodiment of a golf swing training and exercise device for the golf swing training and exercise system according to the present invention.

FIG. 23 shows another embodiment of the golf device 10 according to the present invention. In the embodiment shown in FIGS. 2-3, main portions (i.e., except at junctions or transition locations T) of the sections 20, 22, 24, 26, 28 and 30 of the golf device 10 are generally linear in shape. In the embodiment shown in FIG. 23, the center section 18 is arc-shaped at an angle preferably in the range of about 5 to 10 degrees. The transition locations T have a higher degree of curvature than the transition locations T in the golf device 10 of FIGS. 2-3. The specific dimensions (e.g., angles C, outer diameter OD, lengths Lx and S, etc.) and construction (e.g., hollow vs. solid member, cross-section, etc.) of the golf device 10 in this embodiment are as set forth above for the embodiment of FIGS. 2-3.

Figure 21:
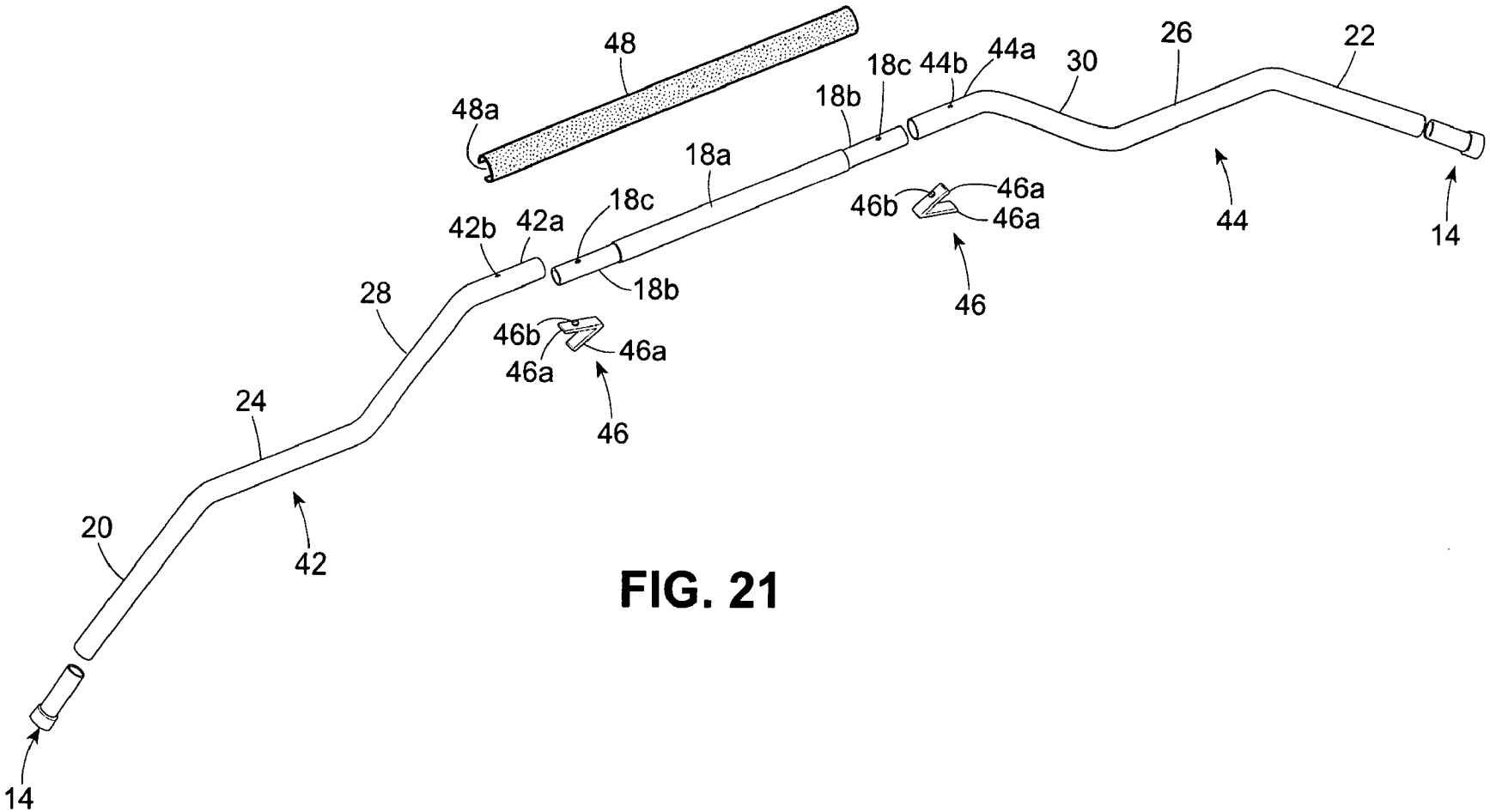
FIG. 21 is an exploded view of another embodiment of a golf swing training and exercise device for the golf swing training and exercise system according to the present invention.

FIG. 21 shows another embodiment in which the golf device 10 is in the form of a multi-piece structure having multiple separate and independent pieces removably connected together to form the golf device. In this embodiment, the multi-piece structure has three separate and independent tubular pieces including the center section 18, first and second tubular unitary pieces generally designated at 42 and 44, respectively, and two connecting members 46 that removably connect the center section 18 to the first and second unitary pieces 42, 44. The first unitary piece 42 includes the end section 20, the first and second intermediate sections 24 and 28, respectively, and a terminal section 42*a* extending from the second intermediate section 28. The second unitary piece 44 includes the end section 22, the first and second intermediate sections 26 and 30, respectively, and a terminal section 44*a* extending from the second intermediate section 30. The terminal sections 42*a* and 44*a* terminate at respective open ends of the first and second unitary pieces 42, 44 and have respective positioning holes or openings 42*b*, 44*b* that open into the interior of the respective first and second unitary pieces 42, 44.

Each of the connecting members 46 comprises a generally V-shaped spring clip having bendable leg portions 46*a*, 46*a* and a button 46*b* extending radially outward from one of the leg portions 46*a*. The center section 18 has a central portion 18*a* and opposite end portions 18*b*, 18*b* with a reduced outer diameter as compared to the outer diameter of the central portion 18*a*. Each of the reduced diameter end portions 18*b* has a positioning hole or opening 18*c* proximate an open end and opening into the interior of the tubular center section 18. The tubular first and second unitary pieces 42, 44 have an inner diameter that is slightly greater than the outer diameter of each of the end portions 18*b* of the center section 18, and an outer diameter that is substantially equal to the outer diameter of the central portion 18*a* of the center section 18.

To assemble the golf device 10 according to the embodiment shown in FIG. 21, each of the spring clips 46 is inserted into a respective open end of the tubular center section 18 by manually compressing the spring clip so as to bring the leg portions 46*a*, 46*a* towards one another and with the vertex of the V-shape forming the spring clip leading into the open end of the center section 18. In this compressed state, each spring clip 46 is pushed into the respective open end of the center section 18 in a lengthwise direction thereof until the button 46*b* is aligned with and protrudes through the corresponding opening 18*c* in the reduced diameter end portion of the center section 18. Thereafter, the end portions 18*b* of the center section 18 are inserted into respective open ends of the tubular unitary pieces 42, 44 and pushed in a lengthwise direction relative to the respective terminal sections 42*a*, 44*a*, with the buttons 46*b* depressed radially inward, until the buttons 46*b* are aligned with and protrude through the respective openings 42*b*, 44*b* of the first and second unitary pieces 42, 44, thereby connecting the center section 18 to the first and second unitary pieces 42, 44. Preferably, each of the buttons 46*b* has a curved face so that as the button is depressed radially inward through the open end of the corresponding tubular unitary piece, the curved face of the button 46*a* easily passes beneath an interior surface of the corresponding terminal section.

To disassemble the multi-piece golf device 10, each of the buttons 46*a* of the spring clips 46 is manually depressed until it clears the respective opening 42*b*, 44*b* of the corresponding terminal sections 42*a*, 44*a* and each of the first and second unitary pieces 42, 44 is pulled lengthwise in a direction away from the respective end portion 18*b* of the center section 18 until the first and second unitary pieces are completely disconnected from the center section 18.

Figure 22:
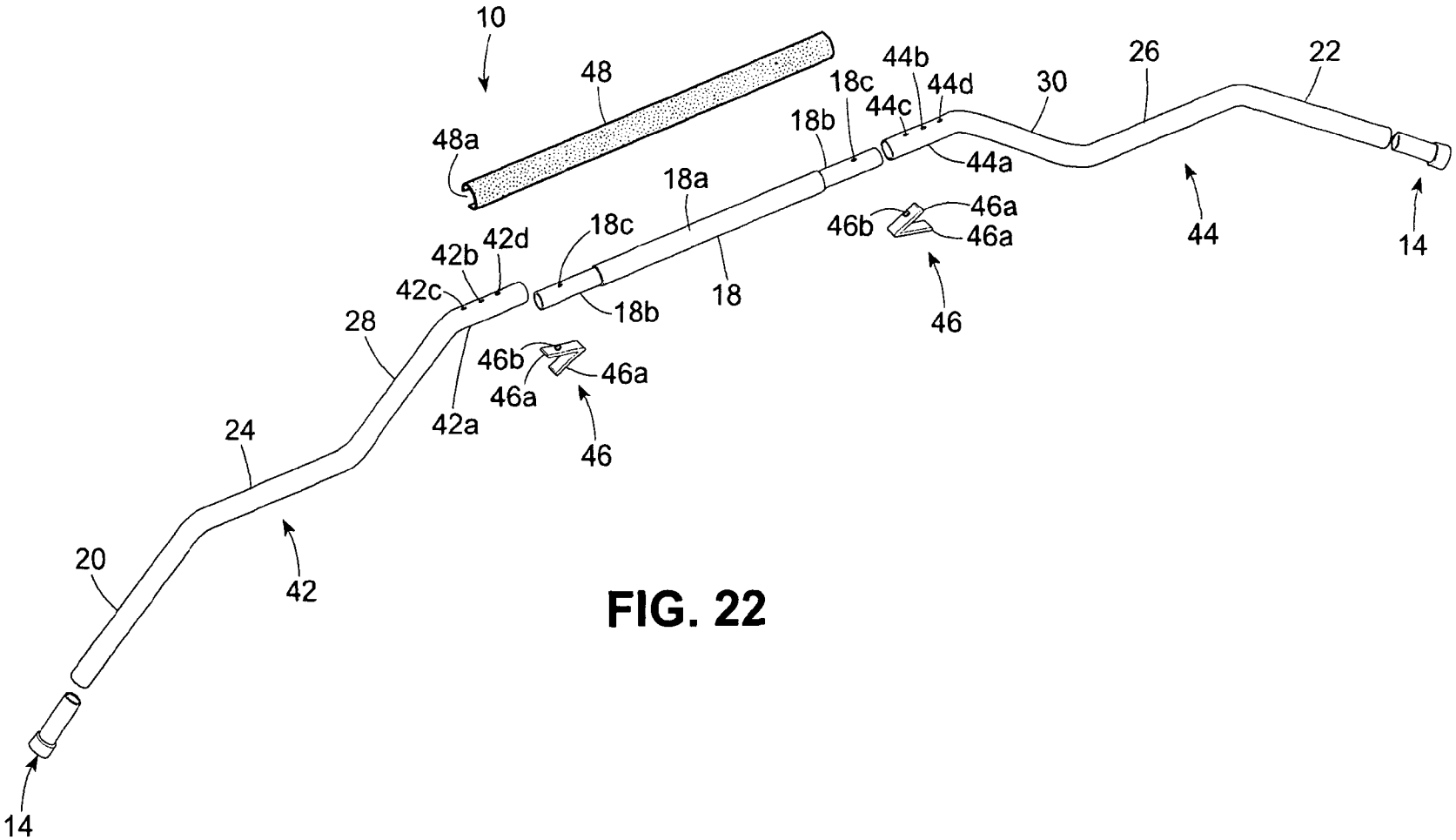
FIG. 22 is an exploded view of another embodiment of a golf wing training and exercise device for the golf swing training and exercise system according to the present invention.

FIG. 22 shows another embodiment of the golf device 10 according to the present invention. The golf device in FIG. 22 has a multi-piece construction as described above for the golf device 10 shown in FIG. 21. Additionally, the golf device 10 in FIG. 22 has an adjustable feature in that it is constructed to permit adjustment of the length Lx of the golf device in the longitudinal direction of the center section 18. More specifically, the terminal sections 42*a*, 44*a* of the respective first and second unitary pieces 42, 44 include additional positioning holes or openings 42*c*, 42*d* and 44*c*, 44*d*, respectively, which, together with the respective openings 42*b* and 44*b*, provide a plurality of longitudinally or axially spaced openings. The openings 42*c*, 42*d* and 44*c*, 44*d* are configured to receive and engage the button 46*b* of the respective spring clips 46 in a manner similar to that described above for the button 46*b* of the spring clips 46 and the holes 42*b* and 44*b* in the golf device 10 shown in FIG. 21. By this construction, the overall length Lx of the golf device 10 in the longitudinal direction of the center section 18 can be adjusted by engaging the button 46*b* of each spring clip 46 with a selected one of the respective holes 42*b*-42*d* and 44*b*-44*d* in the first and second unitary pieces 42, 44.

Thus, the spring clips 46 with the buttons 46*b* protruding from the respective openings 18*c* of the center section 18 and the openings 42*b*-42*d* and 44*b*-44*d* of the first and second unitary pieces 42, 44 define means for adjusting the length of the golf device 10 in the longitudinal direction of the center section 18 of the golf device 10. However, it is understood by those skilled in the art that the means for adjusting the length of the golf device is not limited to the foregoing structure. For example, in FIG. 22 the reduced diameter end portions 18*b* of the center section 18 are inserted into the ends of the respective terminal sections 42*a*, 44*a* of the first and second unitary pieces 42, 44 of larger diameter. Alternatively, the tubular terminal sections 42*a*, 44*a* of the first and second unitary pieces 42, 44 can have reduced outer diameter portions that are inserted into the respective ends of the center section 18 provided with an inner diameter slightly larger than the outer diameter of the terminal sections 42*a*, 44*a*. In this case, the terminal sections 42*a*, 44*a* of the first and second unitary pieces 42, 44 are each provided with a hole similar to the hole 18*c* in the center section 18 of FIG. 22, the opposite end portions of the center section 18 are provided with the plurality of longitudinally or axially spaced openings similar to the openings 42*b*-42*d* and 44*b*-44*d* of the first and second unitary pieces 42, 44 in FIG. 22, and the spring clips 46 are inserted into the terminal sections 42*a*, 44*a* of the first and second unitary pieces 42, 44 rather than into the end portions 18*b* of the center section 18. Additional structures and modifications are suitable for the means for adjusting the length of the golf device 10 without departing from the scope of this invention.

Preferably, the sections of the golf device 10 in each of the foregoing embodiments shown in FIGS. 2-3, 21, 22 and 23 are fabricated from carbon steel. For example, the tubular form of the golf device 10 described above can be fabricated from carbon steel tubing having a circular, oval, rectangular, or any other cross-section as described above with reference to FIGS. 4-6. Other materials such as cold rolled steel, stainless steel, aluminum, plastic, fiber reinforced plastic, fiberglass, and composites are also suitable materials for the sections of the golf device 10. If a plastic is used, the embodiment of the golf device having the single piece construction as described above can be molded as a continuous, homogeneous structure. Nevertheless, the invention is not intended to be limited to the foregoing particular materials of construction.

Referring back to FIG. 2, a plurality of cushion members or pads 48, 50 are provided for removable attachment to selected sections of the golf device 10 and act as cushions to make the golf device comfortable and easy to use. More specifically, the cushion member 48 extends around the center section 18 that is placed on the back of a user (e.g., golfer) during a golf training and exercise routine as further described below. The cushion members 50 extend around the respective first intermediate sections 24, 26 on which the respective hands or forearms of the user are placed during the golf raining and exercise routine. The cushion members 48, 50 are preferably made of rubber, foam or other suitable protective material and preferably have a thickness in a range of about 1/16 inch to 1.0 inch. The cross-section for the cushion members 48, 50 is selected to conform to the cross-section selected for the golf device 10 as described above with reference to FIGS. 4-6.

For the single piece golf devices 10 shown in FIGS. 2 and 23, the cushion members 48, 50 may have a closed tubular construction with a circular cross-section and are mounted around the respective center section 18 and first intermediate sections 24, 26 by inserting the terminal ends of the end sections 20, 22 into the tubular cushion members and passing the sections of the golf device through the tubular cushion members until the cushion members extend around the respective center section 18 and first intermediate sections 24, 26. Alternatively, each of the cushion members 48, 50 may be provided with a longitudinal slit 48*a*, as shown for the cushion member 48 in the golf devices 10 of FIGS. 21 and 22, that permits the cushion member to be opened at the slit sufficiently to permit the cushion member to be positioned around the corresponding section of the golf device. In another alternative embodiment, the cushion members may extend around all of the sections of the golf device 10 or the entire length Lx of the golf device 10. This may be accomplished either by providing plural separate and independent cushion members or a cushion member having a single piece construction.

FIGS. 7-10 show various embodiments of the light source device 14 for the golf swing training and exercise system according to the present invention. In these embodiments, the light sources 14 are in the form of laser devices that are inserted into and/or connected to the respective end sections 20, 22 of the golf device 10. However, the light source device 14 is not limited to a laser device and may be one of various devices known in the art without departing from the scope of this invention.

Figure 7:
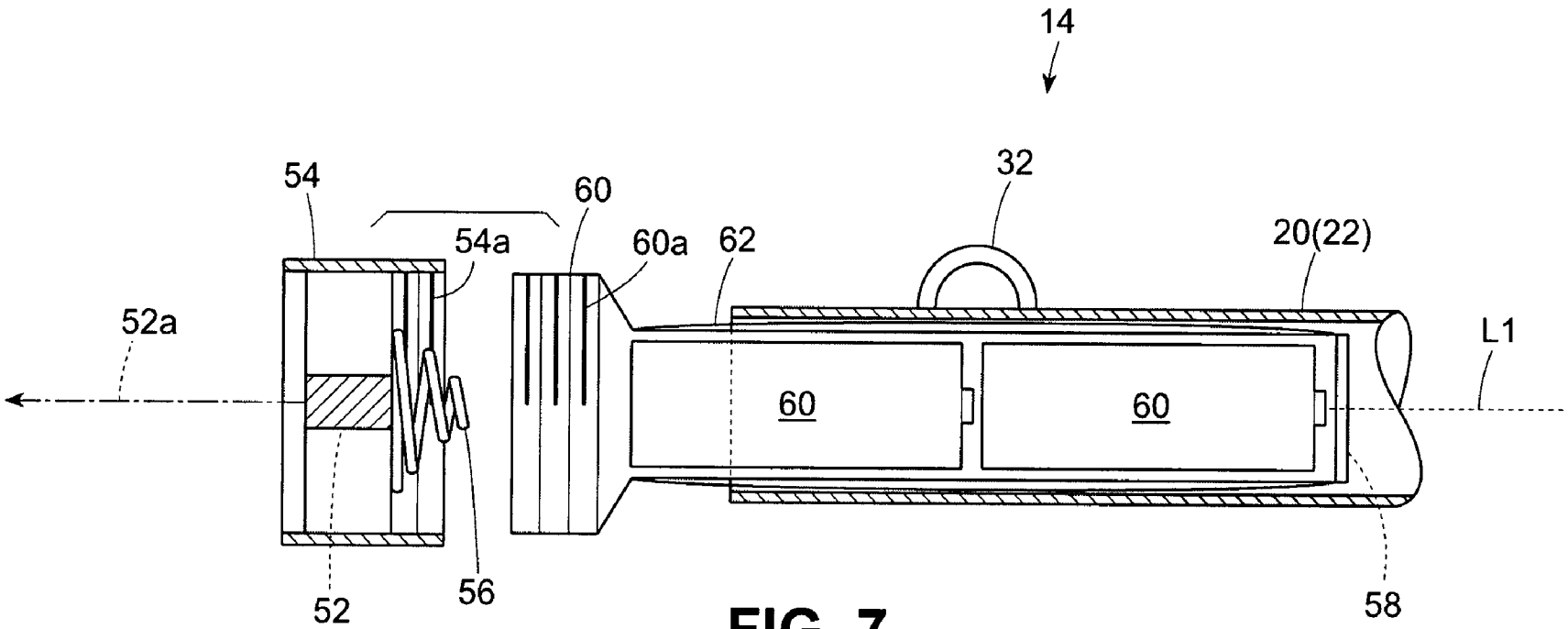
FIG. 7 is a partial cross-sectional view of an embodiment of a light source device for the golf swing training and exercise device according to the present invention.

In the embodiment of FIG. 7, the laser device 14 includes a laser diode 52 mounted in a laser housing 54 that supports a metallic coil spring 56 connected to the laser diode 52. A battery holder or housing 58 that is inserted into the end sections 20, 22 of the golf device 10 houses two disposable batteries 60 that supply the necessary power to activate the laser diode 52. The laser housing 54 has internal threads 54*a* for threaded engagement with external threads 60*a* formed on a front end 60 of the battery housing 58. The battery housing 58 is provided with metallic leaf springs 62 to hold the battery housing 58 in place inside the end sections 20, 22 via frictional force. Alternatively, spring loaded pins or the like may be substituted for the leaf springs 62, and an adhesive material may be used in conjunction with the leaf springs or loaded pins to provide additional strength to the connection between the laser device 14 and the end section of the golf device 10.

The battery housing 58, including the leaf springs 62, together with the batteries 60 and the coil spring 56 connected to the laser diode 52, form an electrical circuit which, when completed, activates or turns the laser diode 53 ON. Thus, in the embodiment of FIG. 7 the laser diode 53 is turned ON to emit a laser beam 52*a* in the direction of the longitudinal axis L1 of the corresponding end section 20, 22 by rotating the laser housing 54 in a clockwise direction (i.e., in the direction in which the internal threads 54*a* of the laser housing 54 are threadedly engaged with the external threads 60*a* of the battery housing 58) until the coil spring 56 contacts a negative terminal of the battery 60 to complete the electrical circuit. To deactivate or turn the laser diode 53 OFF, the laser housing 54 is rotated counterclockwise (i.e., in the direction in which the internal threads 54*a* of the laser housing 54 are disengaged from the external threads 60*a* of the battery housing 58) until the coil spring 56 is disengaged from the negative terminal of the battery 60 to interrupt the electrical circuit.

Preferably, the laser diode 52 in FIG. 7 is powered by two AA size disposable batteries 60 which can provide an estimated battery life of about 40 hours. Batteries of other sizes and types can also be used, such as AAA, C, D and lithium watch or camera-type batteries. Additionally, the batteries 60 may be of the rechargeable type, rather than disposable, in which case recharging can be performed using a separate external charger.

FIG. 8 shows another embodiment of the laser device 14 which differs from the laser device 14 shown in FIG. 7 as follows. In FIG. 8, the batteries 60 are placed directly into the corresponding end sections 20, 22 of the golf device 10, i.e., there is no separate battery housing 58 as in FIG. 7. The terminal ends of the end sections 20, 22 are provided with external threads 20*a*, 22*a* for threaded engagement with the internal threads 54*a* of the laser housing 54. Another difference between the laser devices 14 of FIGS. 7 and 8 is that, for the purpose of turning the laser diode 52 ON/OFF, the laser device 14 in FIG. 8 is provided with a spring-loaded ON/OFF switch 64 connected at one end thereof to the laser diode 52 inside the laser housing 54 for turning the laser diode 52 ON/OFF in a manner known in the art. The other end of the ON/OFF switch 64 extends through and to the exterior of the laser housing 54 so that it is accessible by the user to turn the laser diode 52 ON/OFF during a golf swing training and exercise routine. By this construction, the laser diode 52 is turned ON/OFF by depressing and releasing, respectively, the switch 64, rather than by turning movement of the laser housing 54 as described above for the embodiment of FIG. 7.

The laser device 14 in FIG. 8 is mounted on the end sections 20, 22 of the golf device 10 by first inserting the batteries 60 into the end sections 20, 22 so that a positive terminal of a first one of the batteries 60 contacts the threaded shank 38 of the metallic fastener 36 and a positive terminal of the second battery 60 contacts the negative terminal of the first battery 60. The laser housing 54 is then tightly secured to the terminal end of the corresponding end section 20, 22 by bringing the internal threads 54*a* of the laser housing 54 into threaded engagement with the external threads 20*a*, 22*a* of the corresponding end section. In this tightly secured state, the coil spring 56 connected to the laser diode 52 is brought into contact with the negative terminal of the second battery 60. In the assembled state shown in FIG. 8, the various components of the laser device 14, including the laser diode 52, spring 56, batteries 60 and metallic fastener 36 form an electrical circuit that turns the laser diode ON or OFF, respectively, via the switch 64, which is normally spring-loaded to maintain the switch in its extended OFF position. When turned ON, the laser diode 52 emits a laser beam 52*a* in the direction of the longitudinal axis L1 of the corresponding end section 20, 22. The batteries 60 for supplying power to the laser diode 52 may be of any size and type as described above for the laser device 14 of FIG. 7.

From the foregoing description, it will be appreciated by persons skilled in the art that in addition to functioning as an attachment point on the golf device 10 for the elastic resistance band 34, the metallic fastener 36 also functions to complete the electrical circuit of the laser device 14.

Figure 9:
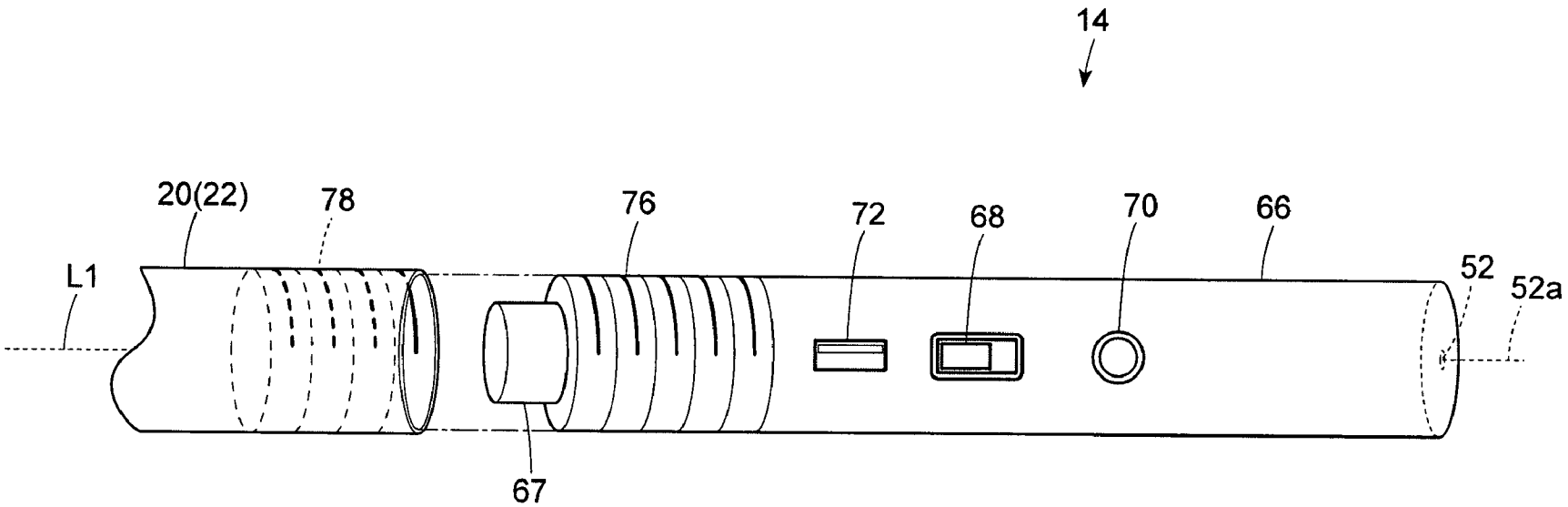
FIG. 9 is a side view of another embodiment of the light source device for the golf swing training and exercise device according to the present invention.

FIG. 9 shows another embodiment of the laser device 14 for the golf swing training and exercise device according to the present invention. In this embodiment, the laser device 14 includes a housing 66 that houses a rechargeable power source (not shown) that is charged to a voltage level required to energize the laser diode 52. Access into the housing 66 for inserting/removing the rechargeable power source is provided via a battery cover 67. Within the housing 66 there is also disposed circuitry (not shown) including a circuit for a power switch 68 to activate/deactivate the power to the laser diode 52, a circuit for a laser switch 70 for turning the laser diode 52 ON/OFF, and a charging circuit for charging the rechargeable power source via a USB charging port or interface 72. The laser switch 70 may be, for example, a pressure-activated button (i.e., a push button) or other type of switch known to those skilled in the art. The various circuits corresponding to the power switch 68, laser switch 70 and USB interface 72 may be one of various devices known to those skilled in the art without departing from the scope of this invention.

The structure and manner of connecting the laser device 14 to the corresponding end sections 20, 22 of the golf device 10 differs from that described above for the laser devices 14 of FIGS. 7 and 8. More specifically, in the embodiment of FIG. 9, the laser device 14 is provided with an external threaded portion 76 at a terminal end thereof proximate the battery cover 74. The terminal ends of the sections 20, 22 of the golf device 10 are provided with an internal threaded portion 78 for threaded engagement with the external threaded portion 76 of the laser device 14 to securely removably connect the laser device 14 to the end sections 20, 22. The connection between the laser device 14 and the end sections 20, 22 may be accomplished in other ways as well, such as by using fastening elements or via friction fit of the components, without departing from the scope of this invention.

During use, the power switch 68 of the laser device 14 is turned ON so that the laser diode 52 can be activated by pressing the laser button 70 to emit a laser beam 52*a* in the direction of the longitudinal axis L1 of the corresponding end section 20, 22. Deactivation of the laser diode 52 is accomplished by pressing again the laser button 70. When the rechargeable power source needs to be recharged, the USB charging port 72 of the laser device 14 is plugged to an external power source (not shown) using a standard USB cable and the rechargeable power source is charged to the voltage level required to energize the laser diode 52. However, charging of the rechargeable batteries may be accomplished in ways other than by using a USB interface and USB cable such as, for example, using pin connectors an corresponding cables or in any other manner known by those skilled in the art. Additionally, an indicator (not shown) visible to the user for indicating the quantity of charge remaining in the rechargeable power source may be incorporated to the housing 66 in any manner known by those skilled in the art.

Figure 10:
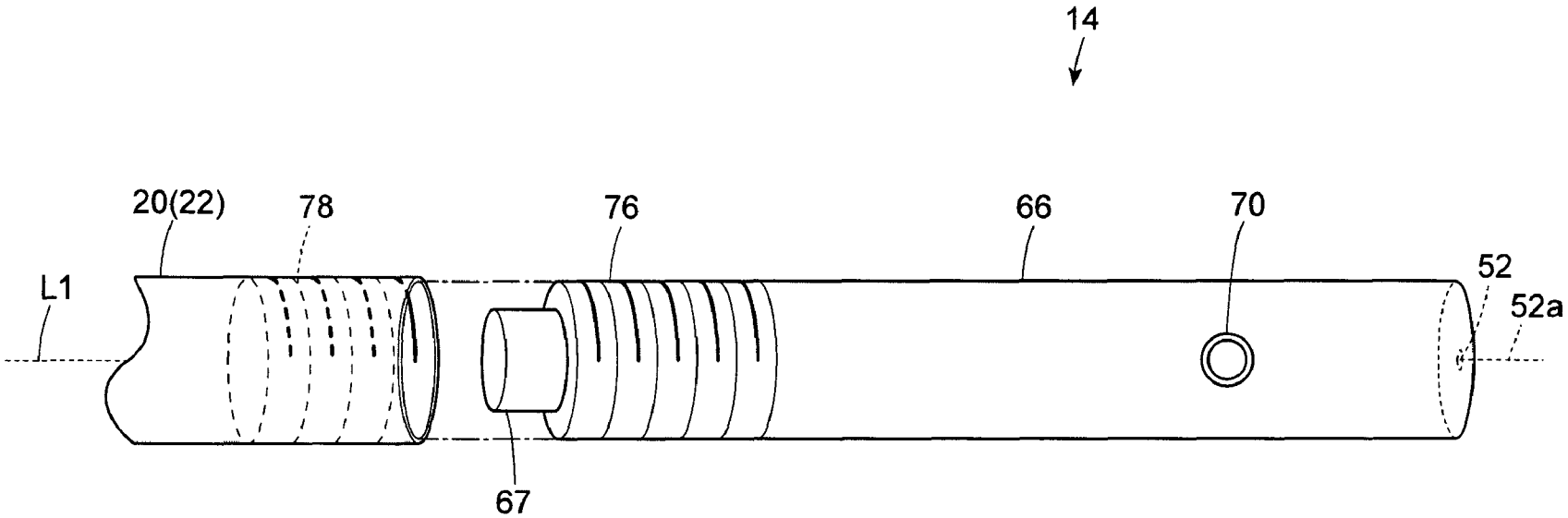
FIG. 10 is a side view of another embodiment of the light source device for the golf swing training and exercise device according to the present invention.

FIG. 10 shows another embodiment of the laser device 14 which is a modified form of the laser device 14 shown in FIG. 9. The laser device 14 in FIG. 10 includes all of the elements described above for the laser device 14 in FIG. 9, except that the laser device of FIG. 10 does not include the power switch 68 and USB interface and corresponding circuits. The batteries used in the laser device 14 of FIG. 10 are of the replaceable type and may include batteries of any type and size as set forth above for the embodiments of laser devices 14 described above with reference to FIGS. 7 and 8.

In each of the foregoing embodiments described above with reference to FIGS. 7-10, the laser diode 52 may be any type of laser, such as, for example, a green laser, red laser, etc. Preferably, the laser diode 52 is a green laser emitting a visible beam of green laser light. The green laser provides a high density energy light source that is more stable and visible than a red laser, for example, particularly in exterior environments. Further, the materials for the components of the laser device 14 may be fabricated from various suitable materials, including metallic, plastic and/or composite materials. The structure (e.g., shapes) and dimensions (e.g., diameters) of these components are also selected to conform to the particular structure and dimensions selected for the end sections 20, 22 of the golf device 10 to which the laser devices 14 are respectively mounted.

Figure 11:
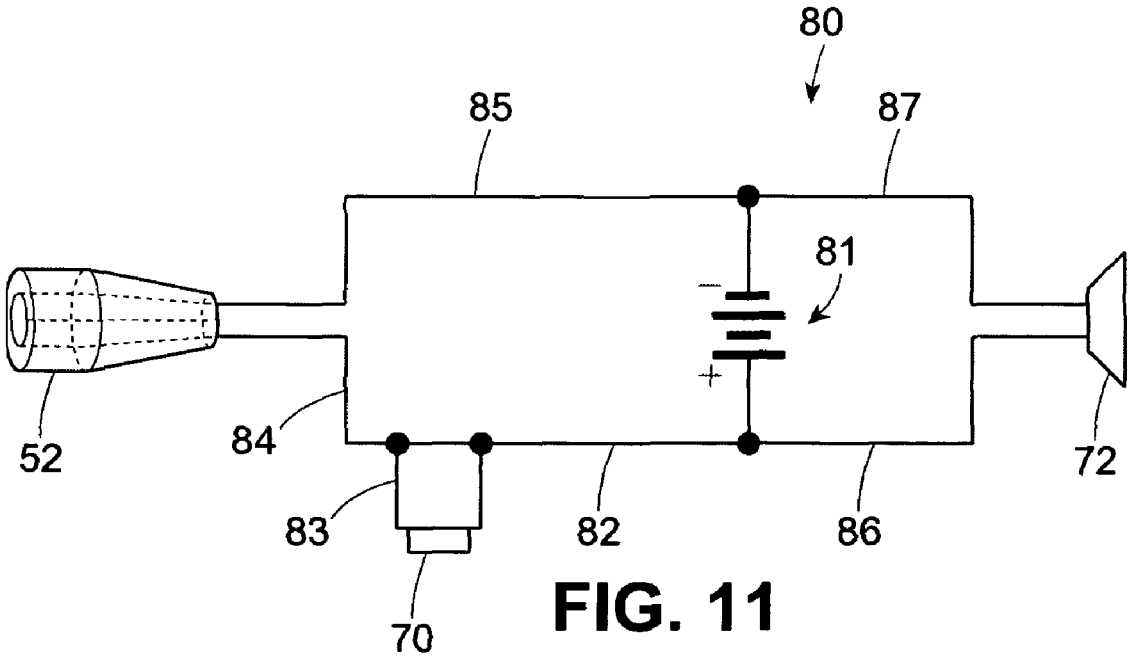
FIG. 11 is a circuit diagram showing the electrical connections between a time control circuit and the light source device shown in FIG. 9.
Figure 12:
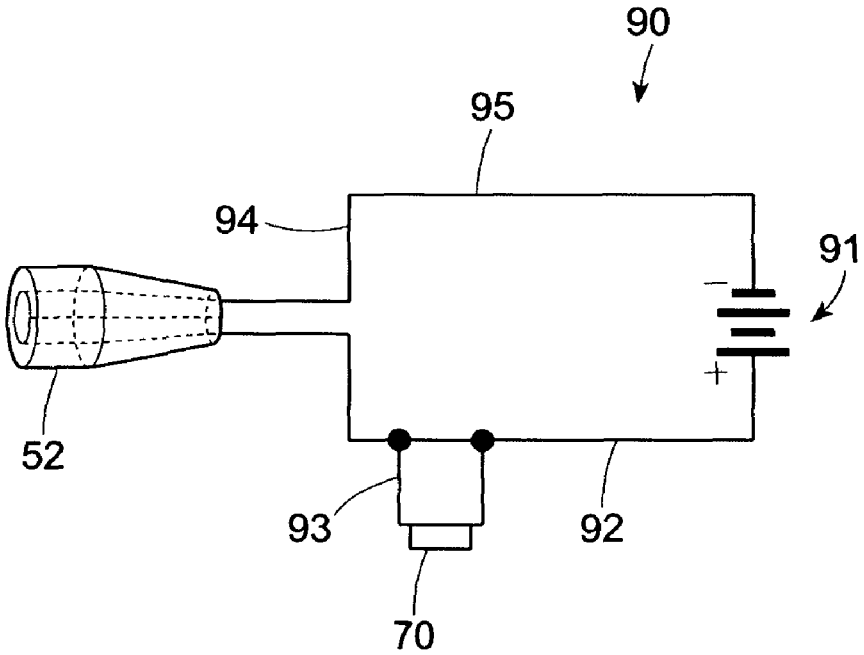
FIG. 12 is a circuit diagram showing the electrical connections between a time control circuit and the light source device shown in FIG. 10.

FIGS. 11 and 12 are directed to another feature of the golf swing training and exercise system according to the present invention and show circuit diagrams of two embodiments of a a timer associated with the laser device 14 for shutting off the laser diode 52 automatically at a preselected period of time after the laser diode 52 is activated.

In FIG. 11, the timer, generally designated at 80, is adapted for use in connection with the embodiment of the laser device 14 shown in FIG. 9 which incorporates a rechargeable power source that is charged to a voltage level required to energize the laser diode 52. The positive terminal of a power source, generally designated at 81, is connected by way of a conducting line 82 to one terminal of a time control switch 83. The other terminal of the time control switch 83 is connected by way of a conducting line 84 to the positive terminal of the laser light 52. The time control switch 83 is operated by depressing the push button 70. Each time the push button 70 is depressed, the time control switch 83 connects conducting line 82 to the laser light 52, allowing the power source 81 to energize laser light 52 for a preselected period of time. The negative terminal of power source 81 is connected by way of a conducting line 86 to one terminal of the USB charging port 72, and the negative terminal of power source 81 is connected by way of conducting line 87 to the other terminal of the USB charging port 72. When the USB charging port 72 is plugged into an external power source (not shown), the power source 81 is charged to the voltage level required to energize the laser light 52.

In FIG. 12, the timer, generally designated at 90, is adapted for use in connection with the embodiment of the laser device 14 shown in FIG. 10 which uses disposable batteries to energize the laser diode 52. The positive terminal of a power source 91 is connected by way of a conducting line 92 to one terminal of a time control switch 93. The other terminal of the time control switch 93 is connected by way of a conducting line 94 to the positive terminal of a laser light 400. The negative terminal of power source 91 is connected by way of conducting line 95 to a negative terminal of the laser light 52. The time control switch 93 is operated by depressing a push button 70. Each time the push button 70 is depressed, the time control switch 93 connects conducting line 92 to the laser light 52, allowing the power source 91 to energize laser light 52 for a preselected period of time.

As described above for each embodiment of the timer circuit shown in FIGS. 11 and 12, each time the push button 70 is depressed, the power source is allowed to energize laser light 52 for a preselected period of time. Preferably, this preselected period of time is in the range of about 3 to 10 minutes, and more preferably about 5 minutes. However, other suitable preselected periods of time can be selected in conformance with the particular golf swing training and exercise routine employed by the user using the golf swing training and exercise system.

The resistance device of the golf swing training and exercise system according to present invention will be now described with reference to FIGS. 1, 13A-13B, 14A-14B, 15A-15B, and 16. The resistance device includes the elastic resistance band 34 and either the strap member 37 or one of the fastening members, generally designated at 100 and 102, in FIGS. 15A and 15B.

Figure 13A:
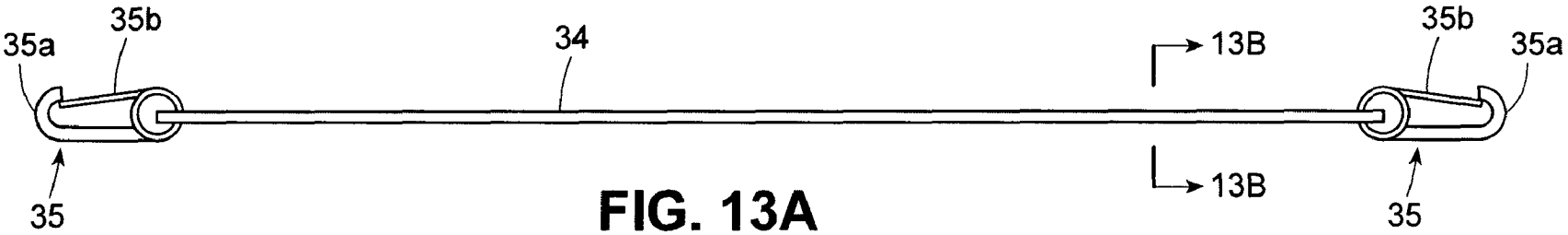
FIG. 13A is a side view and FIG. 13B is a cross-sectional view taken in the direction of line 13B-13B in FIG. 13A of an elastic resistance member for the golf swing training and exercise system according to the present invention.
Figure 13B:
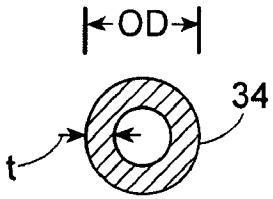

With reference to FIGS. 13A and 13B, the elastic resistance band 34 has a tubular construction with an outer diameter OD preferably in the range of about ¼ inch to ⅓ inch, and with a wall thickness t preferably in the range of about 1/32 inch to 3/16 inch. Two connecting clips, generally designated at 35, are integrally connected to respective terminal end portions of the elastic resistance band 34 for removably attaching the elastic resistance band 34 to one of the connectors 32 of the golf device 10 (e.g., see FIGS. 2-3) and to a connecting part 39 of the strap member 37, respectively. In this embodiment, each of the connecting clips 35 has a generally hook-shaped part 35*a* and a biasing part 35*b* that can be biased relative to the hook-shaped part 35*a* from a closed position (shown in FIG. 13A) to an open position (i.e., by biasing the biasing part 35*b* downwards in the view shown in FIG. 13A) in which the connecting clip 35 can be connected to the connecting part 39 of the strap 37 or one of the connectors 32 of the golf device 10. The terminal end portions of the elastic resistance band 34 are integrally connected to the biasing part 35*b* of the respective connecting clips 35 by any suitable means known by those skilled in the art. This construction of the connecting clips 35 permits quick connect and disconnect of the elastic resistance band 34 relative to the golf device 10 and strap member 37. However, it is understood by those skilled in the art that the means for connecting the elastic resistance band to the connecting part 39 of the strap member 37 and the connectors 32 of the golf device 10 is not limited to the connecting clips 35. Any other type of connection between the elastic resistance band 34 and the golf device 10 and strap member 37 is suitable so long as such connection allows for quick connect and disconnect of the elastic resistance band 34 from the golf device 10 and strap member 37. For example, instead of connecting the connecting clips 35 to the respective connectors 32 on the golf device 10, the connectors 32 can be omitted and the connecting clips of the elastic resistance band 34 can be connected directly to attachment holes (not shown) provided on one or both of the end sections 20, 22 of the golf device 10.

Preferably, the elastic resistance band 34 may comprise any flexible, elastic and resilient material, for example, rubber, composites of rubber, or any other synthetic or natural elastic materials. Other materials are suitable for the elastic resistance band so long as the resistance band may be extended/elongated under tension and contracted to its original state in a repetitive fashion during a golf swing training and exercise routine. The connecting clips 35 are preferably made from a plastic material. Alternatively, a metal or a plastic coated metal may be used to fabricate the connecting clips 35. Furthermore, while the elastic resistance band 34 shown in FIGS. 13A-13B has a tubular profile, other types of profiles are suitable for the elastic resistance band 34. For example, a non-tubular thin elastic band of various widths and thicknesses can be used in lieu of the tubular profile.

The resistance device 16 of the golf swing training and exercise device 10 according to the present invention is also not limited to an elastic resistance band as described above with reference to FIGS. 13A and 13B. In this regard, in an alternative embodiment the required resistance in the direction of movement of the golf device 10 during a golf swing training and exercise device may be generated by connecting the golf device 10 to a steel or non-metallic cable that is attached to weights of any apparatus capable of generating resistance. For example, the golf device 10 can be connected to a cable column at a gym or a BowFlex®-type arrangement.

Figure 14A:
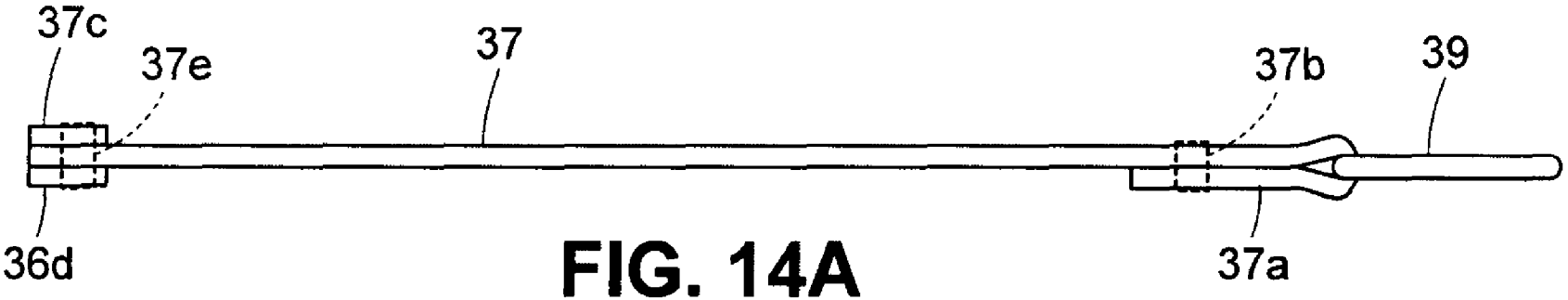
FIGS. 14A and 14B are a side view and a top view, respectively, of a strap member for anchoring the elastic resistance member of the golf swing training and exercise system according to the present invention.
Figure 14B:
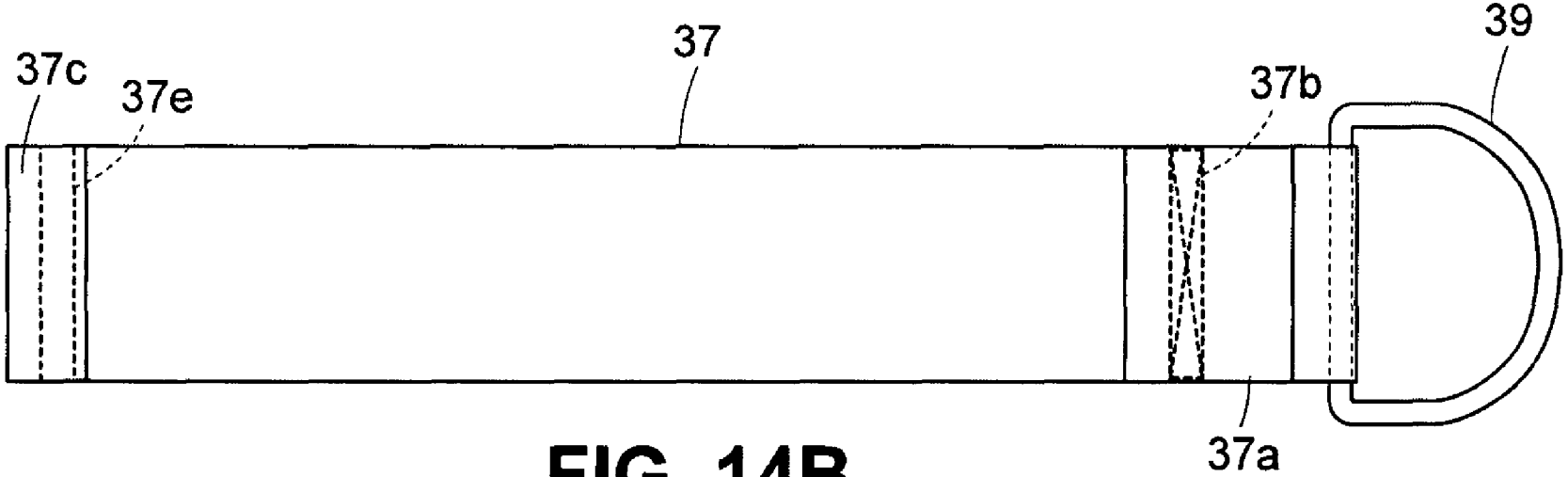

Referring now to FIGS. 14A and 14B, the strap member 37 comprises a strip of material having first and second opposite ends and a central elongated portion between the first and second ends. The first end is provided with multiple folded portions 37*c*, 37*d* of the material sewn together with stitching 37*e* to form a protrusion that resembles the head of a T-shaped structure formed of the protrusion and the central elongated portion of the strap member 37. The second end of the strip of material has a single folded portion 37*a* sewn with stitching 37*b* to form a loop portion that supports a connecting member 39 having a ring-shaped configuration which, in this embodiment, is in the form of a D-shaped ring. However, the connecting member 39 is not limited to a D-shaped ring, and other ring-shaped configurations, such as circular, rectangular or triangular, are suitable.

The strip of material for the strap member 37 is preferably made of nylon with preferred dimensions including a thickness (i.e., without folds) in the range of about 0.25 inch to 0.125 inch, a width in the range of about ⅛ inch to 12 inches, and a length in the range of about 2 inches to 20 feet. More preferably, the material for the strap member 37 is about 1 inch in width, about 1/32 inch in thickness, and about 8 inches in length. Any natural or man-made fabric is also suitable for the strip of material. The D-shaped ring is preferably made from steel, plastic or any other metallic or polymeric material. During use (e.g., during a golf swing training and exercise routine), the strap member 37 is removably connected between the elastic resistance member 34 and the fixed structure A in the manner shown in FIG. 1. To accomplish this, the second end of the strap member 37 is removably attached to one end of the elastic resistance band 34 by clipping the connecting clip 35 of the elastic resistance band 34 to the D-shaped ring of the strap member 37. Although not specifically shown, the protrusion of the strap member 37 is anchored to the fixed structure A in any suitable manner so long as the first end of the strap member 37 is securely fixed to the fixed structure A during a golf swing training and exercise routine. For example, the strap member 37 may be anchored to a closed door by securing a part of the central elongated portion between the door and the door frame with the D-shaped ring and the protrusion of the strap member positioned on opposite sides of the closed door. Alternatively, when a long (e.g., 20 feet) strap member 37 is used, the strap member can be wrapped around a door (open or closed) vertically and/or horizontally with the D-shaped ring and the protrusion of the strap member positioned on opposite sides of the door.

Figure 15B:
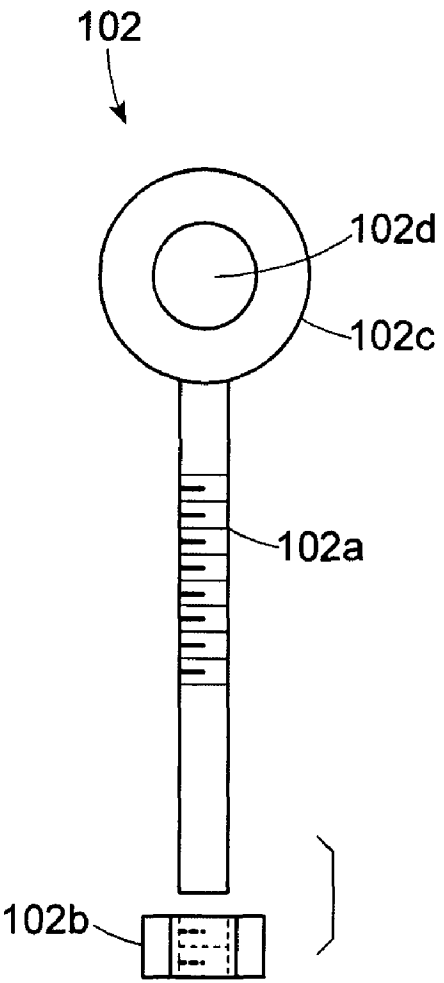
FIGS. 15A and 15B are front views showing embodiments of an anchor member for anchoring the elastic resistance member of the golf swing training and exercise system according to the present invention.
Figure 15A:
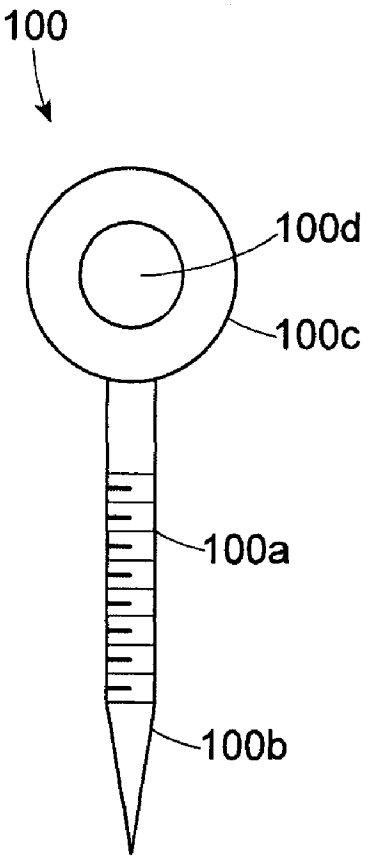

FIGS. 15A and 15B show embodiments of securing members 100, 102 as alternative means for securing the elastic resistance band 34 to the fixed structure A without the necessity of using the strap member 37. In FIG. 15A, the securing member 100 has a threaded shank portion 100*a* terminating in a pointed end 100*b*, and a head portion in the form of an eyelet 100*c* that is generally ring-shaped with an opening 100*d*. The securing member 100 is anchored by being screwed to a structure, such as a wall, door, door frame, etc. The elastic resistance band 34 can then be removably connected to the securing member 100 by clipping one of the connecting clips 35 of the elastic resistance member to the eyelet 100*c* of the anchored securing member 100. In the embodiment of FIG. 15B, the securing member 102 has a threaded shank portion 102*a* and head portion in the form of an eyelet 102*c* that is generally ring-shaped with an opening 102*d*, and further includes a threaded nut 102*b* for threaded engagement with the threaded shank portion 102*a*. The securing member 102 is adapted to be used in place of the securing member 100 in situations in which the nut and bolt configuration of the securing member 102 is more suitable rather than the screw type configuration of the securing member 100. The manner of connecting the elastic resistance band 34 to the securing member 102 is as set forth above for the securing member 100.

The materials and dimensions for the securing members 100, 102 are selected such that when anchored to a fixed structure, the securing members provide secure attachment for the elastic resistance band 34 during a golf swing training and exercise routine. Preferably, the eyelets 100*c* and 102*c* of the securing members 100, 102 have an outer diameter in the range of about ⅛ inch to 1.0 inch in diameter.

Figure 16:
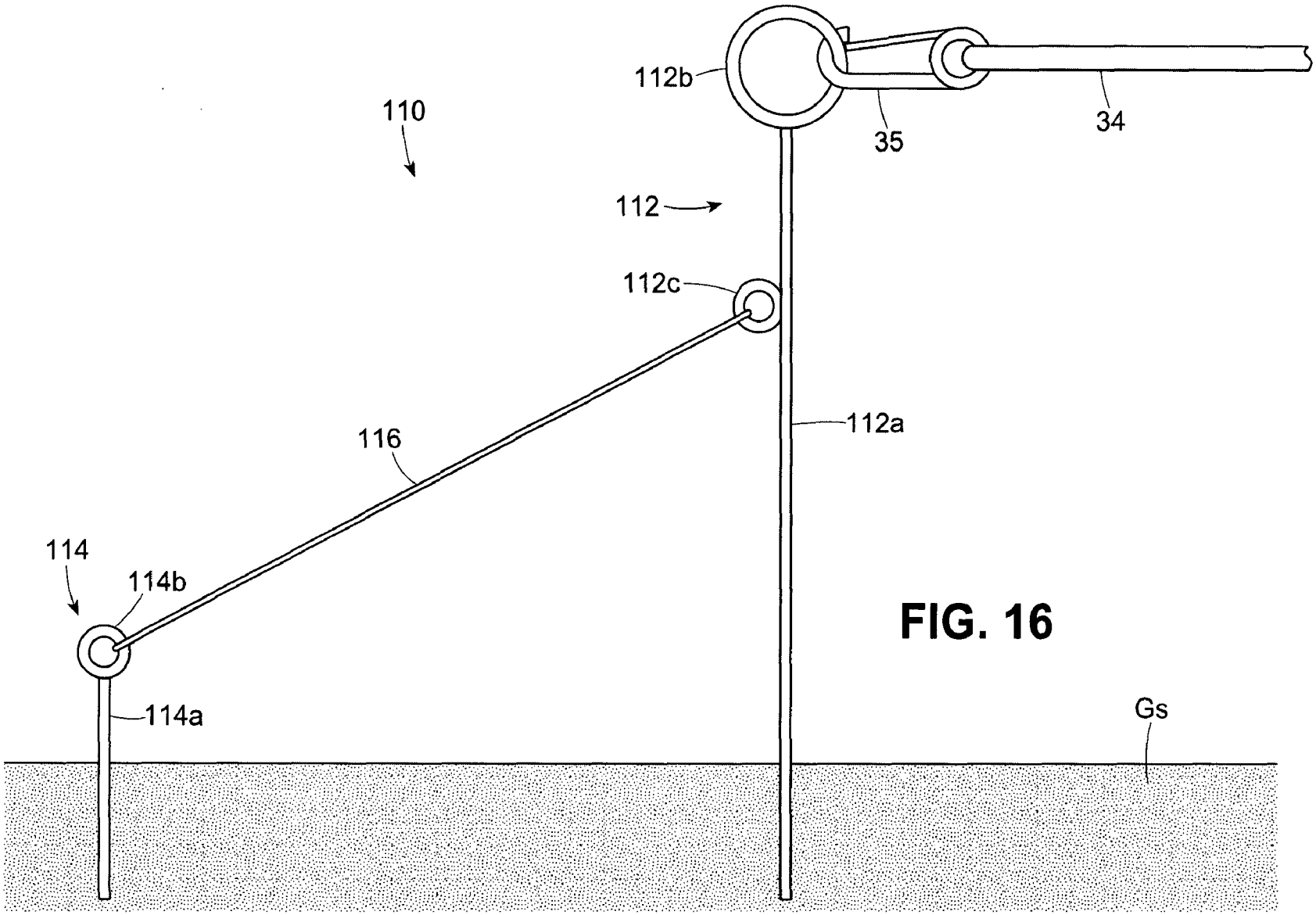
FIG. 16 is a side view of an anchoring system for anchoring in an outdoor environment the elastic resistance member of the golf swing training and exercise system according to the present invention.

FIG. 16 shows an embodiment of an anchoring system 110 particularly adapted for anchoring the elastic resistance band 34 to an outdoor fixed structure during a golf swing training and exercise routine. The anchoring system 110 includes a first stake member 112*a* having a pointed end (not shown) and an eyelet 112*b*, and a second stake member 114 having a pointed end (not shown) and an eyelet 114*b*. The first stake member 112 also has another eyelet 112*c* slightly below the eyelet 112*b* at a position between the pointed end and the eyelet 112*b*. The stake members 112, 114 are anchored by placing them a preselected distance from one another and driving the pointed ends of the first and second stake members 112, 114 a sufficient distance into a ground Gs until the stake members are firmly secured in the ground. The first and second stake members 112, 114 are connected together using a cable or string 116 by attaching one end of the string 116 to the eyelet 112*c* of the first stake member 112 and the other end of the string to the eyelet 114*b* of the second stake member 114.

During use of the golf swing training and exercise system of the present invention, the elastic resistance band 34 is connected to the anchoring system 110 by clipping one of the connecting clips 35 of the elastic resistance band 34 to the eyelet 112*b* of the first stake member 112. The second stake member 114, when connected to the first stake member 112 via the string 116, functions as an accessory ground support stake that adds strength and stability to the anchoring system 110. It is understood, however, that the second stake can be omitted when the first stake 112 provides the required anchoring support for the elastic resistance band 34 during a golf swing training and exercise routine. Preferably, in this embodiment the first and second stakes 112, 114 have a length of about 5 to 6 feet and 2 to 4 feet, respectively. However, other lengths are suitable for the first and second stakes 112, 114 so long as the first and second stakes are capable of being driven a sufficient distance into the ground and extend upwardly from the surface of the ground to provide a secure and stable arrangement for the anchoring system 110.

Figure 17A:
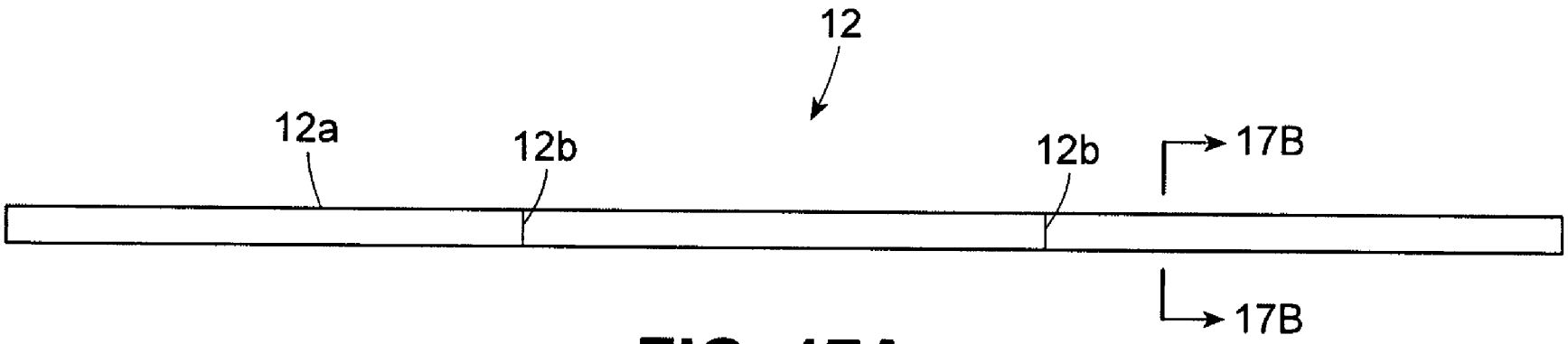
FIG. 17A is a top view and FIG. 17B is a cross-sectional view taken in the direction of line 17B-17B in FIG. 17A of an optically reflective device for the golf swing training and exercise system according to the present invention.
Figure 17B:
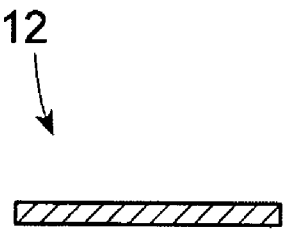

FIGS. 17A and 17B show a side view and a cross-sectional view, respectively, of the optically reflective device 12 of the golf swing training and exercise system according to the present invention. In this embodiment, the optically reflective device 12 comprises a member in the form of a generally linear (i.e., straight) reflective strip, sheet or layer of material with a surface 12*a* on which the laser beam 52*a* emitted from the laser device 14 of the golf device 10 is reflected to provide visual guidance to the user during a golf swing training and exercise routine. The reflective strip has three sections adapted to be folded over one another at fold lines 12*a* and 12*b* for storage. Alternatively, instead of having the three folding sections, the reflective strip can be provided without fold lines and instead be configured to be rolled for storage. The reflective strip can be made of a rigid (e.g., with three folding sections) or flexible (e.g., capable of being rolled) material. For example, the material can be a white vinyl material or any type of metallic or polymeric material capable of reflecting laser light. As shown in FIG. 17B, the reflective strip has a solid construction with a generally rectangular cross-section and a preselected thickness. However, other forms of construction are suitable for the reflective strip, including a hollow construction with a suitable cross-sectional shape.

Figure 18B:
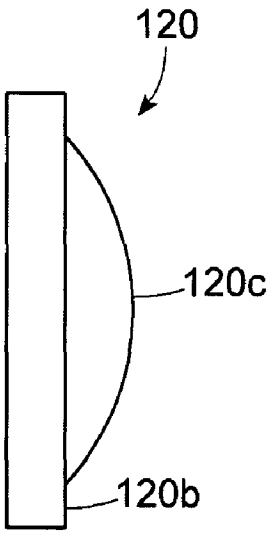
FIGS. 18A, 18B and 18C are top, side and front views, respectively, of an embodiment of a balancing device for the golf swing training and exercise system according to the present invention.
Figure 18A:
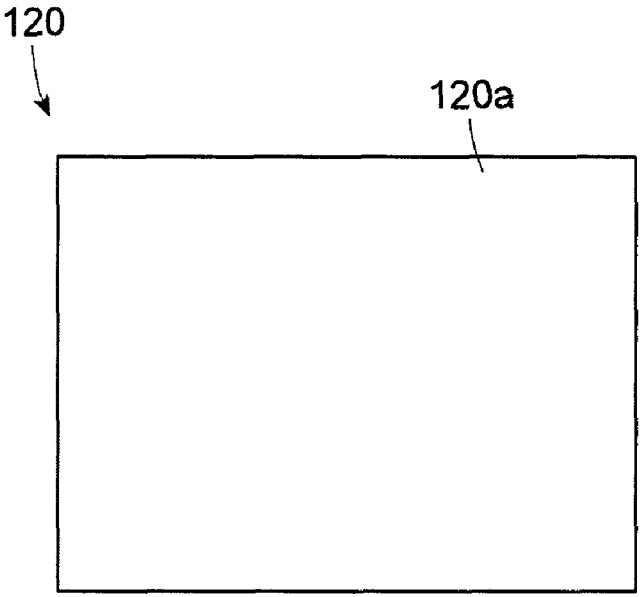
Figure 18C:
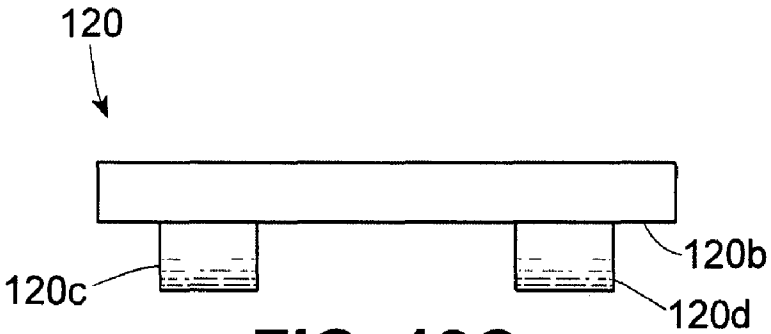
Figure 19B:
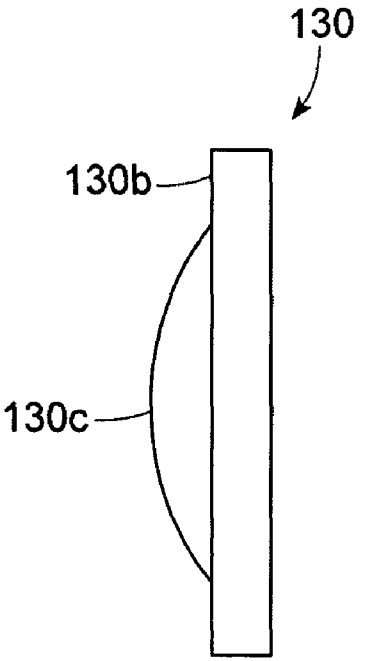
FIGS. 19A, 19B and 19C are top, side and front views, respectively, of another embodiment of a balancing device for the golf swing training and exercise system according to the present invention.
Figure 19A:
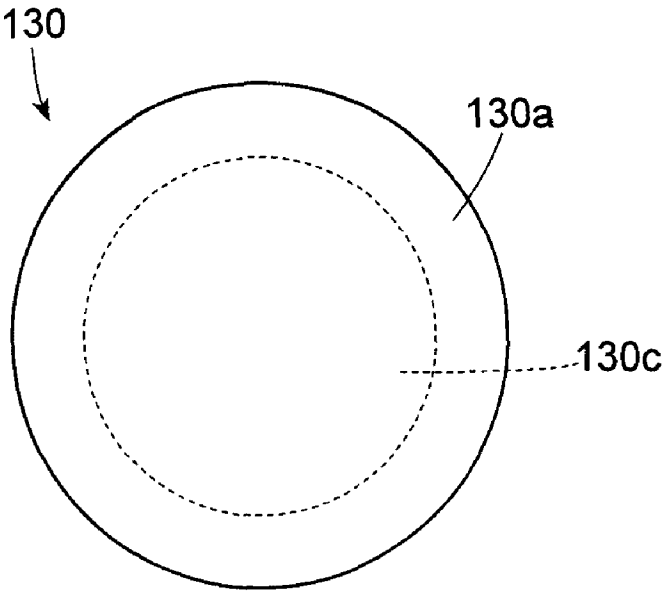
Figure 19C:
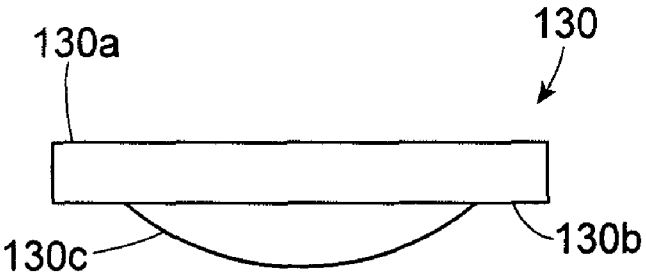

FIGS. 18A-18C and 19A-19C show embodiments of balancing devices 120, 130 for use with the golf swing training and exercise system according to the present invention. In FIGS. 18A-18C, the balancing device 120 is configured as a rocker board having an upper surface 120*a*, a lower surface 120*b*, and support portions 120*c*, 120*d* extending from the lower surface 120*b* for supporting the rocker board on a ground surface during a golf swing training and exercise routine. Preferably, the upper surface of the rocker board has a width in the range of about 8 inches to 18 inches and a length in the range of about 8 to 36 inches. In FIGS. 19A-19C, the balancing device 130 is configured as a wobble board having generally circular upper and lower surfaces 130*a*, 130*b* and a generally spherically-shaped support portion 130*c* extending from the lower surface 130*b* for supporting the wobble board on a ground surface during a golf swing training and exercise routine. Preferably, the upper surface of the wobble board has a diameter in the range of about 8 inches to 24 inches and the support portion 130*c* has a radius in the range of about 2 inches to 12 inches. The rocker board and the wobble board are preferably fabricated from a suitable wood or plastic polymeric material.

Figure 20:
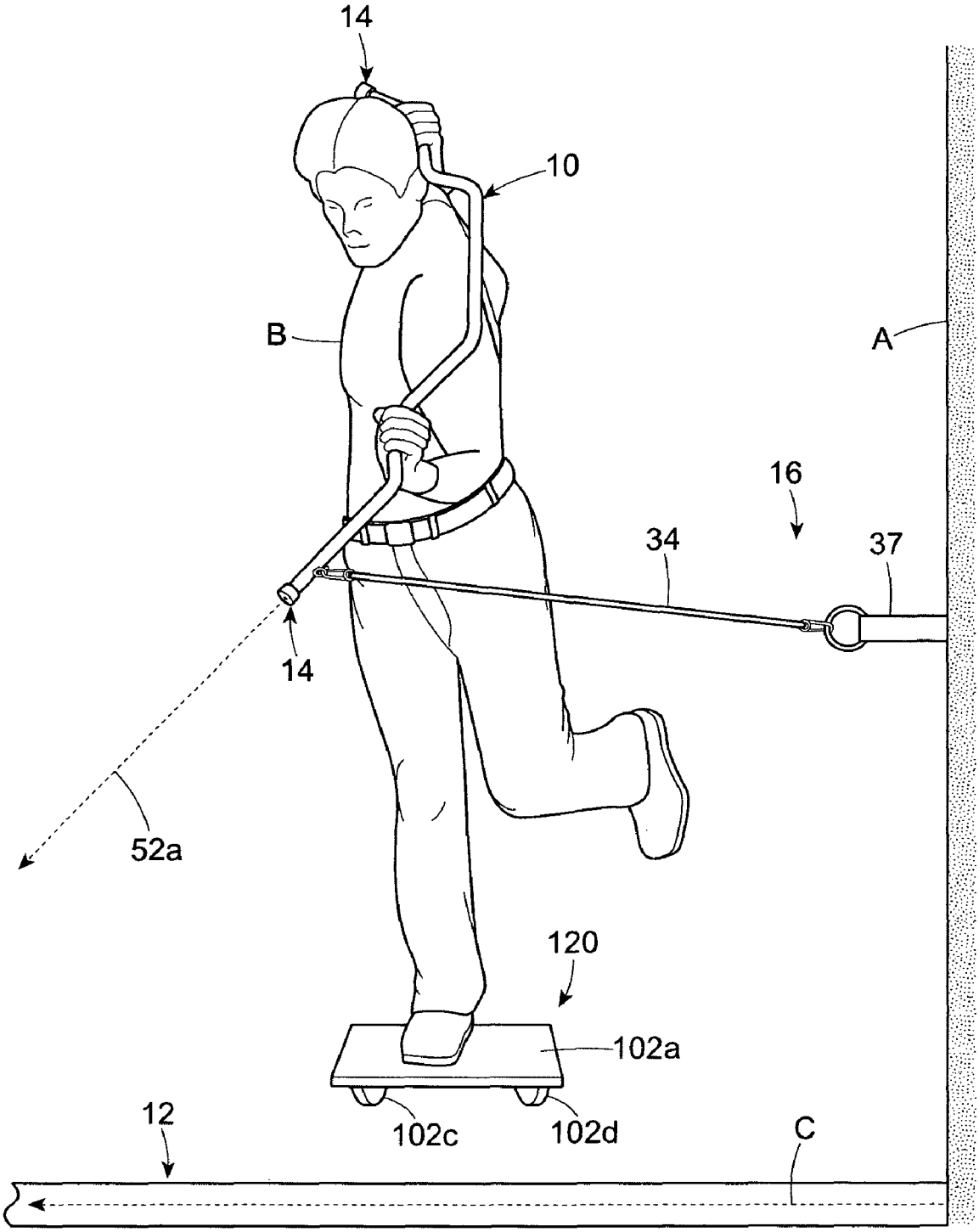
FIG. 20 is a front perspective view of a golfer utilizing the balancing device shown in FIGS. 18A-18C.

FIG. 20 is a front perspective view showing a user (e.g., golfer) B utilizing one form of the foregoing balancing device during a phase of a golf swing training and exercise routine. The rocker board 120 is used as the balancing device and, as described in more detail below, in the particular point of the phase of the routine shown in FIG. 20 the user has one foot (i.e., right foot) on the surface 120*a* of the rocker board 120 while lifting the other foot (i.e., left foot).

FIGS. 24A-24B, 25A-25B, and 26A-26B show embodiments of stabilizing members 140 of the golf swing training and exercise system according to the present invention. One or more of the stabilizing member 140 is configured to be removably mounted substantially on the center section 18 of the golf device 10, and are designed to provide a generally flat surface contact with the back of the user. The primary purpose of the stabilizing member 140 is to ensure that the golf device remains perpendicular to the user's spine during a golf swing training and exercise routine. Another advantage of stabilizing member 140 is that it facilitates a stable and comfortable relationship between the user and the golf device 10. Thus the stabilizing member defines means for stabilizing the golf device on the back of the user to maintain the golf device in a position generally perpendicular to the spine of the user during a golf swing training and exercise routine.

Figure 24A:
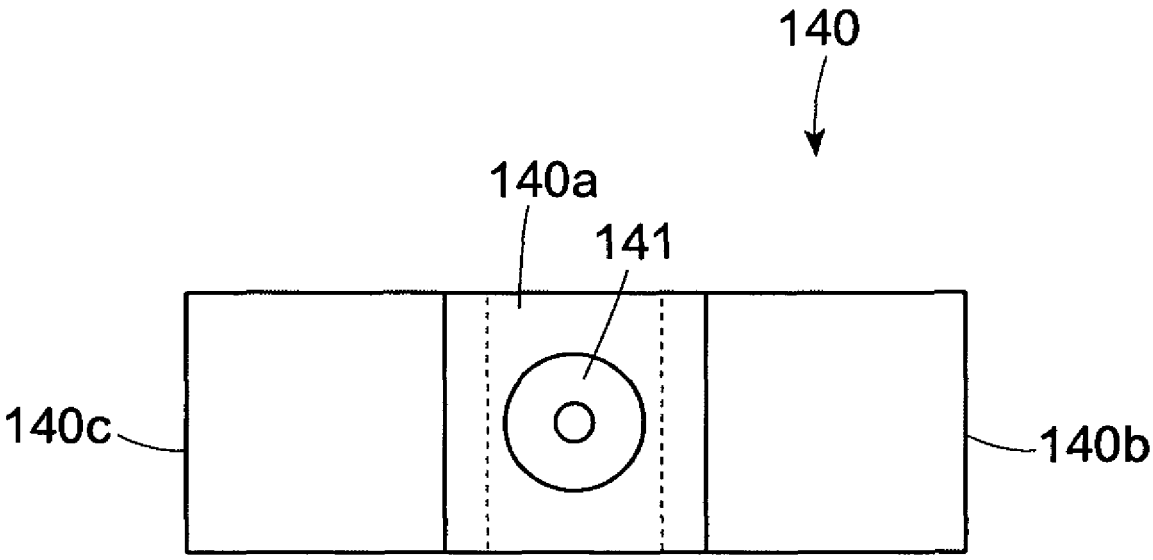
FIGS. 24A and 24B are a rear view and a side view, respectively, of an embodiment of a stabilizing member for the golf swing training and exercise system according to the present invention.
Figure 24B:
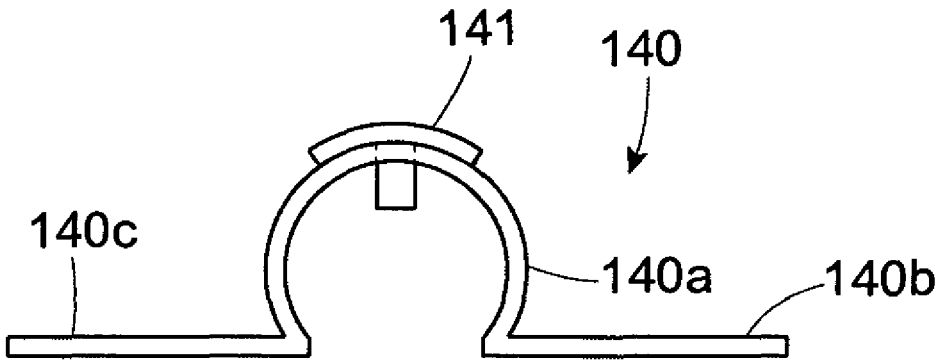

As shown in FIGS. 24A-24B, the stabilizing member 140 has a generally circular open tubular portion 140*a* and a pair of side portions 140*b*, 140*c* extending from opposite edges of the open tubular portion 140*a*. The open tubular portion 140*a* is dimensioned to receive a portion of the central section 18 of the golf device 10 in the manner shown in FIGS. 25A and 25B. The stabilizing member 140 is integrally connected to the center section 18 of the golf device 10 by a connector 141 having a pin portion that extends through an opening in the tubular portion 140*a* of the stabilizing member 140 and into an opening (not shown) formed in the center section 18 of the golf device 10. Other forms of connection between the stabilizing member 140 and the center section 18 of the golf device 10 are suitable without departing from the scope of this invention.

In this embodiment, the open tubular portion 140*a* of the stabilizing member 140 is generally circular-shaped. However, other shapes are suitable for the tubular portion 140*a* so long as the selected shape conforms to the cross-sectional shape of the center section 18 of the golf device 10. The stabilizing member 140 is preferably fabricated of a cushioning material, including rubber, foam, plastic, etc. or any other material which may improve comfort while providing the required stability during a golf swing training and exercise device.

Figure 25A:
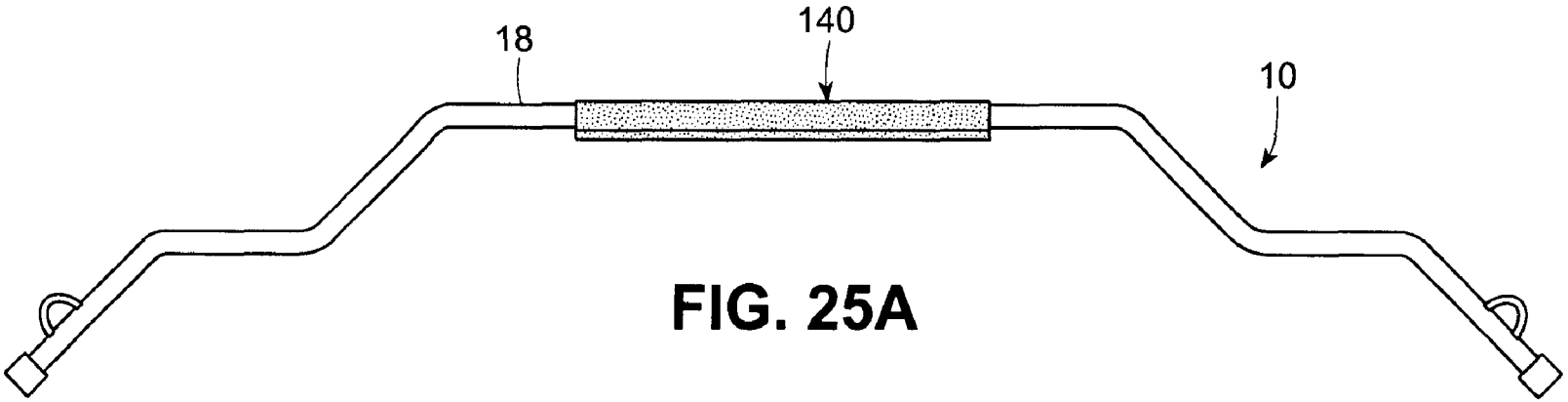
FIGS. 25A and 25B are a side view and a front view, respectively, showing the stabilizing member of FIGS. 24A-24B mounted on the golf swing training and exercise device according to the present invention.
Figure 25B:
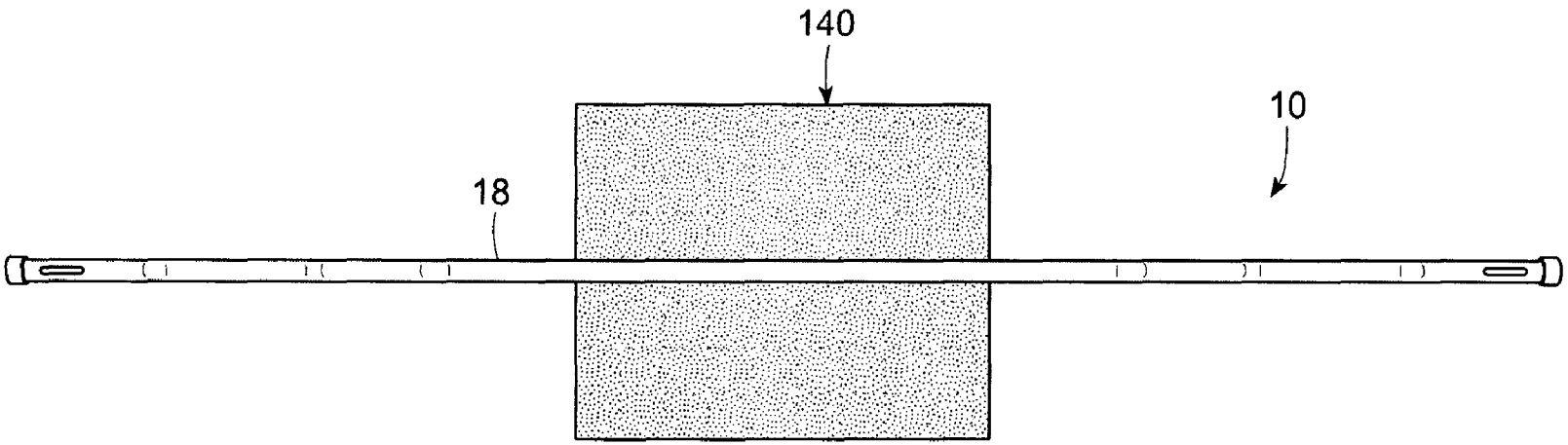
Figure 26A:
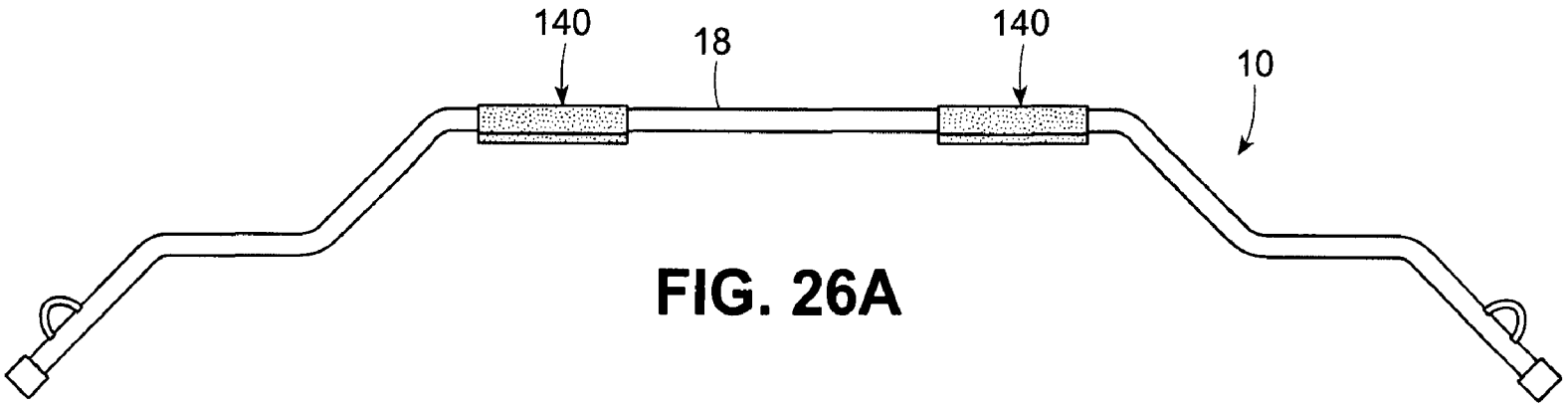
FIGS. 26A and 26B are a side view and a front view, respectively, showing another embodiment of the stabilizing member mounted on the golf swing training and exercise device according to the present invention.
Figure 26B:
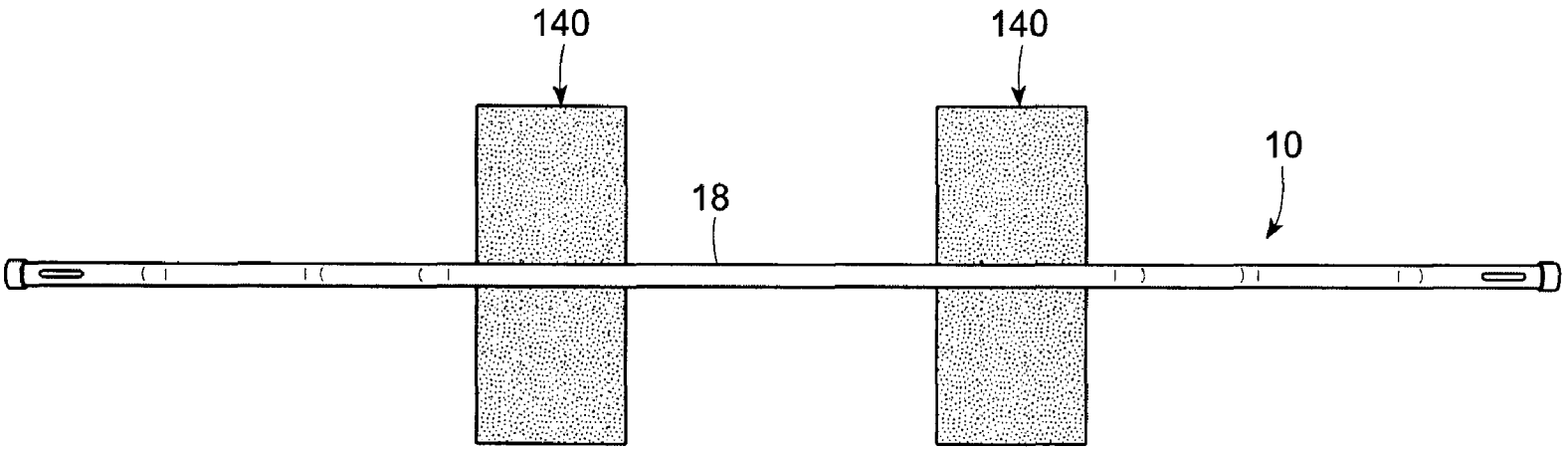
Figure 27B:
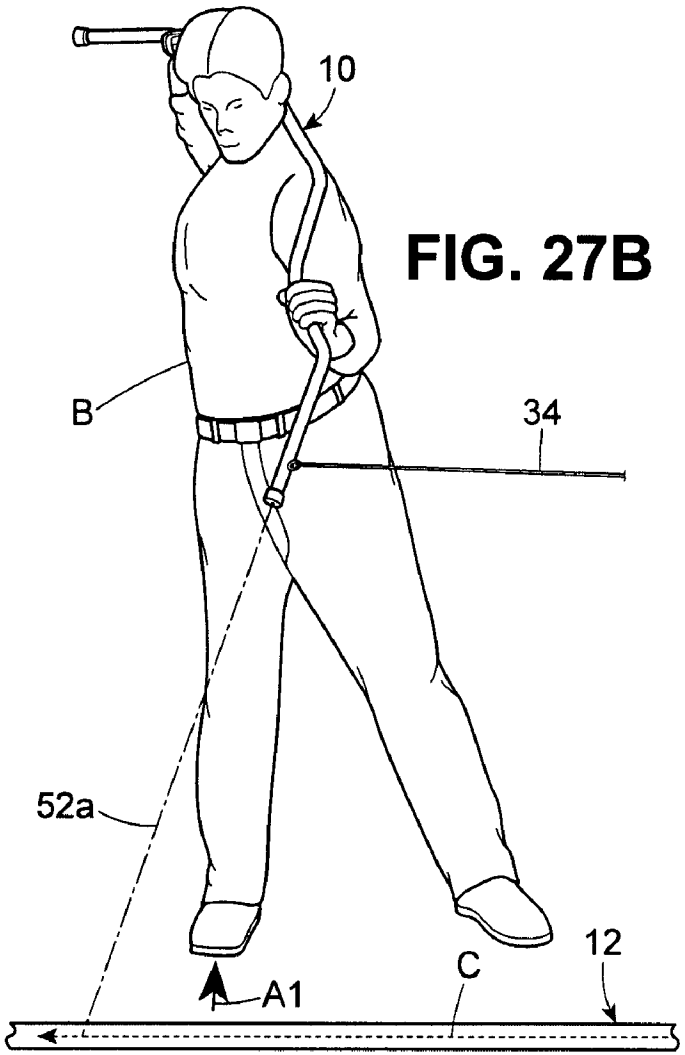
FIGS. 27A to 27H show a method of using the golf swing training and exercise system according to the present invention.
Figure 27A:
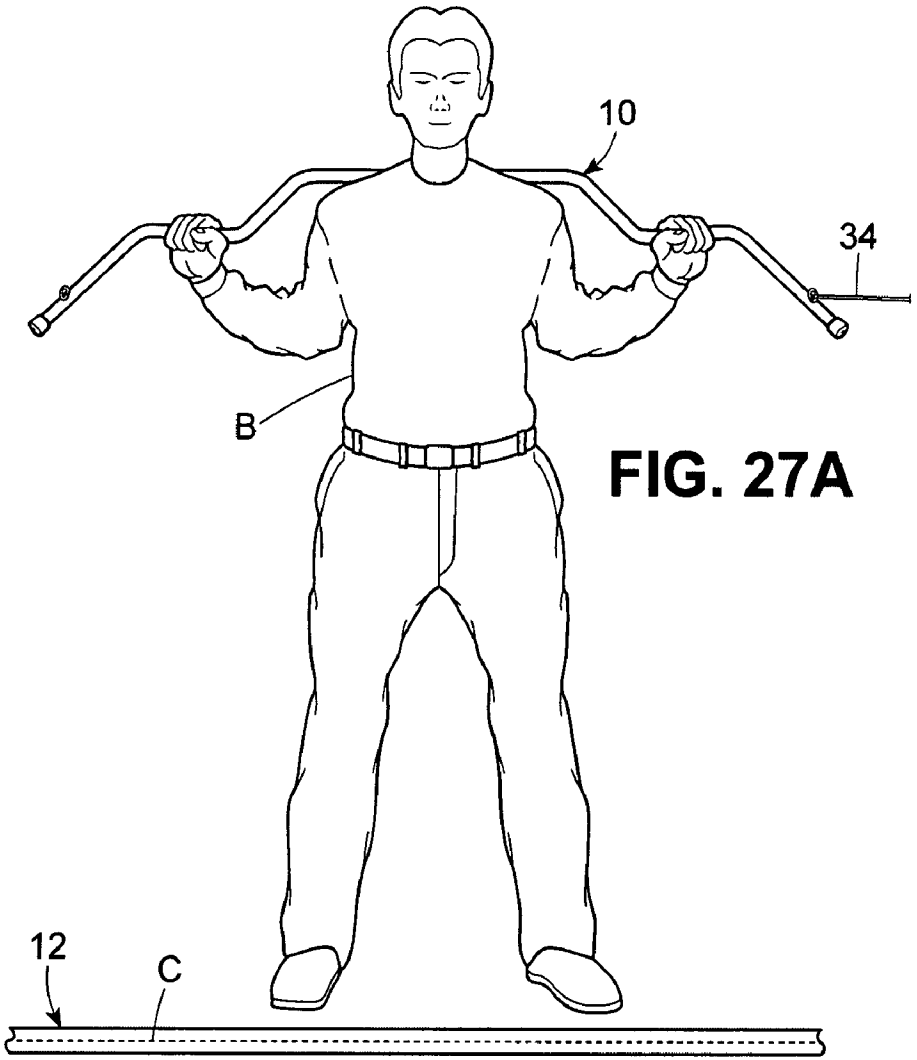
Figure 27D:
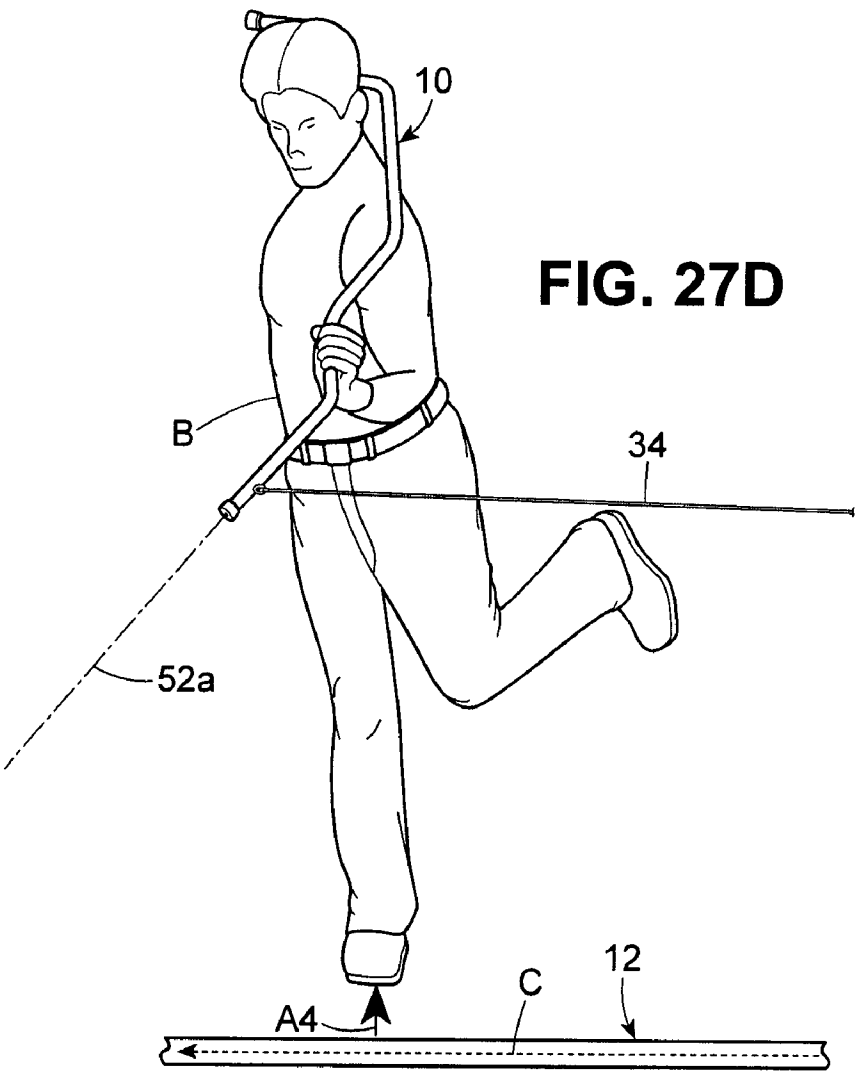
Figure 27C:
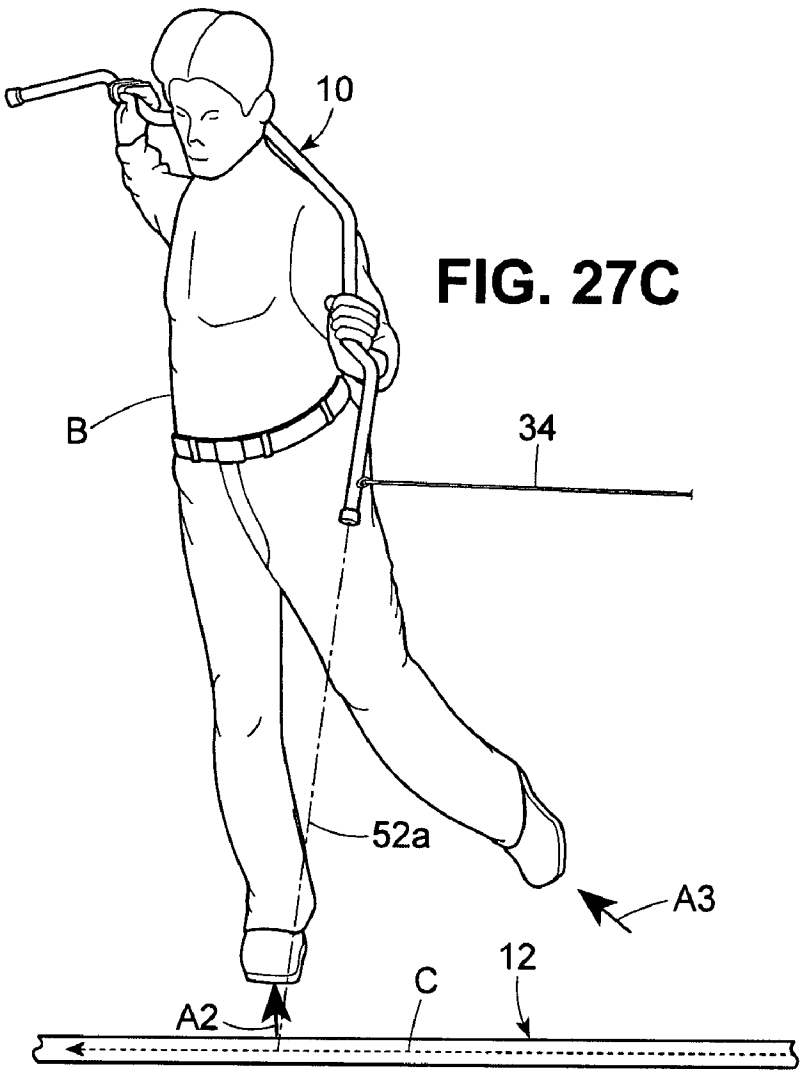
Figure 27F:
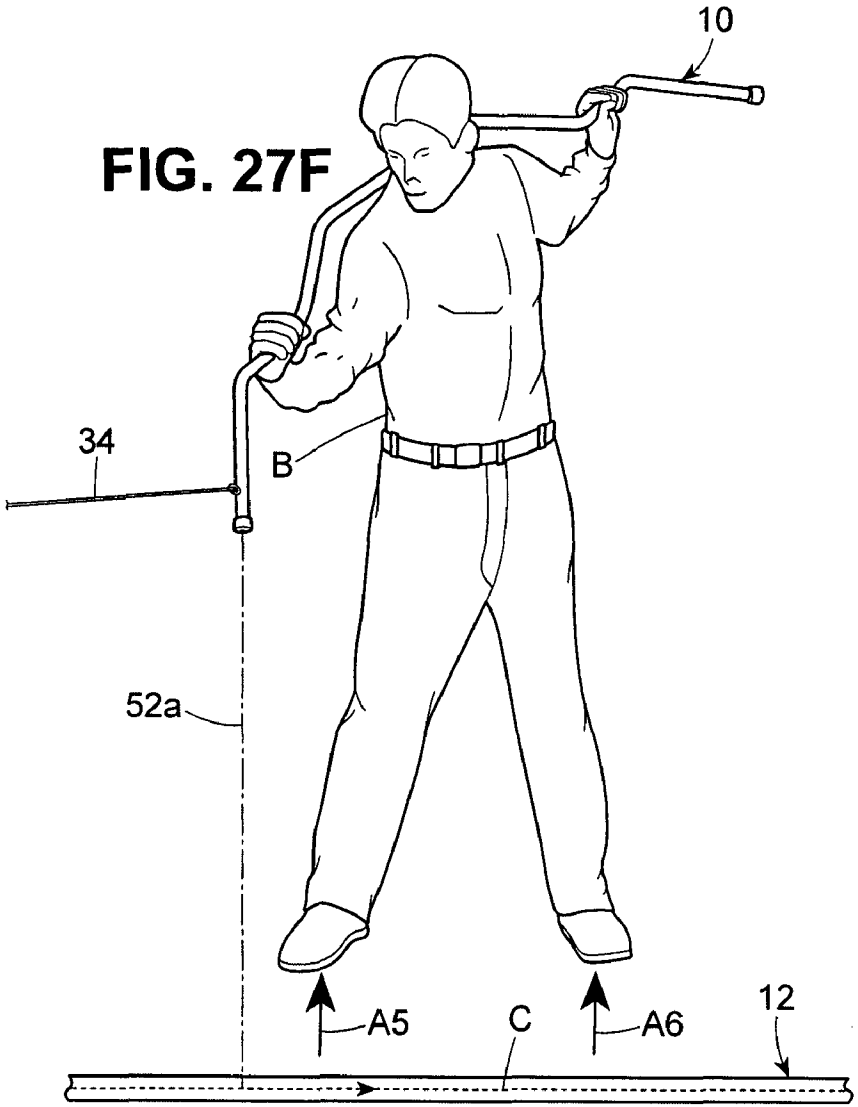
Figure 27E:
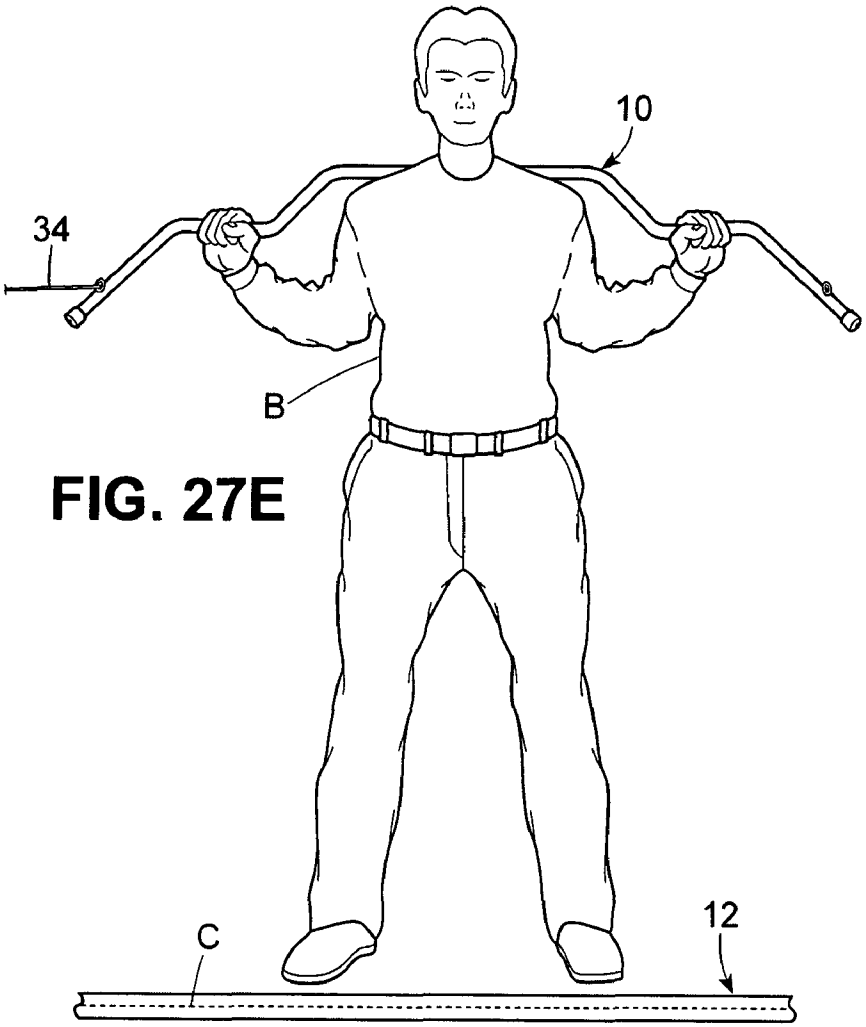
Figure 27H:
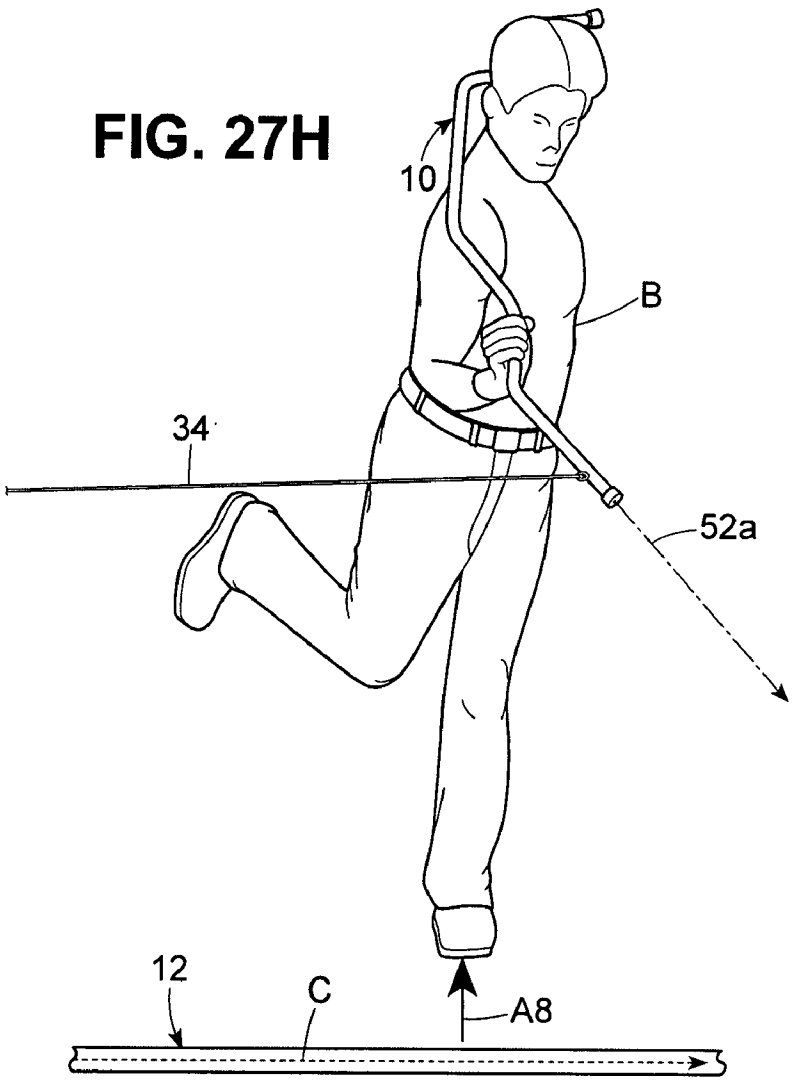
Figure 27G:
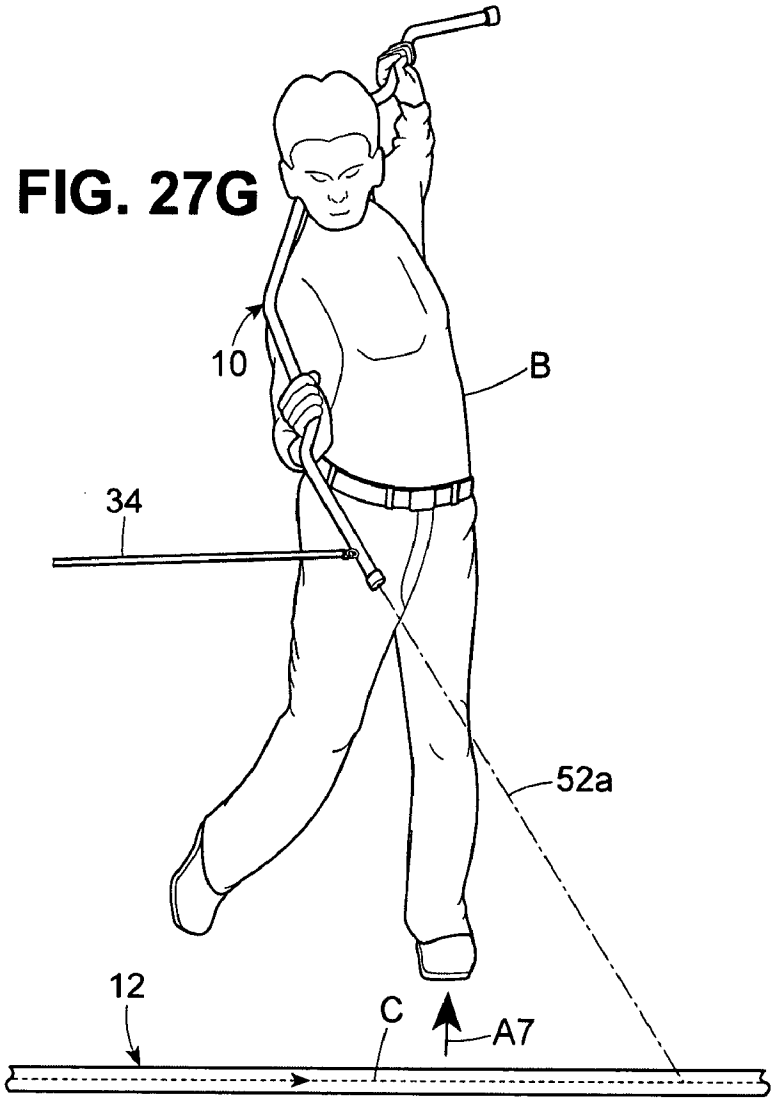

FIGS. 26A and 26B show another embodiment in which two of the stabilizing members 140 are mounted on the center section 18 of the golf device 10 instead of one as in the embodiment of FIGS. 25A-25B. In this embodiment, the stabilizing members 140 are spaced-apart along the center section 18 at a distance selected to provide the appropriate comfort and stability for the particular user of the golf device 10. However, it is understood by those skilled in the art that there is no limitation to the number, location, configuration and/or particular dimensions of the stabilizing members 140 used in connection with the golf device 10.

It is also understood by those skilled in the art that the means for stabilizing the golf device on the back of the user during a golf swing training and exercise routine is not limited to the above-described structures and configurations. For example, instead of attaching the stabilizing member(s) 140 on the center section 18 of the golf device 10 as described above, a rear portion of section 18 may have a flat or planar surface for contacting the back of the user during a golf swing training and exercise routine. In this regard, when the sections of the golf device 10 are configured with the rectangular cross-section shown in FIG. 6, one of the flat surfaces (i.e., the rear flat surface) will function as the flat surface that is contacted with the back of the user during the golf swing training and exercise routine.

The above-described golf swing training and exercise system according to the present invention can be utilized to implement a quick, complete and easy to use progressive training and exercise program to activate and strengthen the necessary muscles used in a golf swing. The main purpose and function of such training and exercise program is to correct various flaws or faults in a golf swing as follows:

1) correct the reverse pivot by strengthening, facilitating and increasing proprioception of the back leg hip and thigh muscles enabling to hold 90% of the person's body weight steady and not compensating by shifting the weight on the front foot;

2) correct the swaying of hips/pelvis backward and forward during the backswing and downswing respectively by strengthening, facilitating and increasing proprioception of the glut medius muscles;

3) correct the swaying forward at ball contact by strengthening the front leg/hip muscles;

4) prevent too much weight on the back foot at ball contact by strengthening, facilitating and increasing proprioception of the front thigh and hip muscles;

5) prevent overuse of arms during the swing caused by lack of rotation of the torso/shoulders by strengthening/facilitating the inhibited internal/external oblique muscles;

6) promote shifting 110% of the golfer's dynamic body weight to the front foot on the start of the down swing by strengthening, facilitating and increasing proprioception the front leg hip and thigh muscles;

7) prevent losing spine angle during the swing by strengthening, facilitating and increasing proprioception lumbar paraspinal and glut max muscles (as described below, maintaining the laser light on straight line on the reflective strip will give immediate feedback to the brain, ensuring reinforcing constant spine angle throughout the swing);

8) correct out of plane movement during the backswing and downswing (e.g.,. maintaining the laser light on a proper straight line on the floor will give immediate feedback to the brain ensuring proper plane throughout the swing);

9) correct poor balance by performing exercises on one leg increasing strength, facilitation and increasing proprioception all of the thigh and hip muscles;

10) promote the transfer of 90% of the body weight on the front foot at the finish of the golf swing; and 11) improve the tempo.

The correction of the foregoing swing faults is accomplished using the golf swing training and exercise system according to the present invention through a preferred progressive training and exercise program as described in detail below.

Initially a user begins the training/exercise without resistance (i.e., without use of the resistance device 16) while the user's two feet are on the ground, to advancing by adding resistance via the elastic resistance band 34 of the resistance device 16, then progressing to stepping off one foot at the end of the swing and then to only standing on one foot, and finally repeating the procedure on the rocker board 120 and then the wobble board 130. As described below, the rocker and wobble boards add to the difficulty of the exercises, increasing strength, facilitation and balance for the advanced and more athletic golfer. The laser beam 52*a* emitted from the laser device 14 mounted on the golf device 10 will project a straight line C on the reflecting strip 12 (e.g., FIGS. 1, 20 and 27A-27H) when the user's shoulders are rotated properly in plane. This helps reinforce the proper movement patterns sub-cortically and subconsciously.

The various Phases I-XXIV of a preferred training and exercise program using the golf swing training and exercise system according to the present invention are described below. Only the specific steps of the exercises in Phase V are illustrated and will be described with references to FIGS. 27A-27H. Reference will also be made to FIGS. 1-26B for the components of the golf swing training and exercise system utilized during the exercises throughout the various phases of the program.

Phase I

Phase I of the program requires the use of the golf device 10 with the laser devices 14 and with or without the stabilizing member(s) 140. The laser light reflective strip 12 is positioned on the ground or on any surface on which the exercise is performed by the user. The golf device 10 is not connected to the resistance device 16 for this phase of the program. The user initially positions in front of the reflecting strip 12 and then places the golf device 10 on the upper back (i.e., on the thoracic spine, not on the neck). The user's posture is then set as follows:

1) Head, Cervical-spine, Thoracic Spine-Lumbar spine aligned.

2) Shoulders—shoulder blades retracted and down.

3) Abdominal brace (pelvic tilt and transverse abdominis tightened).

Phase I of the program includes a backswing exercise and a downward swing exercise performed as described below.

Backswing—The user rotates completely around the spine axis to a full backswing while maintaining: (a) spine angle;

(b) a plane such that the laser beam 52*a* from the laser device 14 moves in a straight line C along the surface of the reflecting strip 12; (c) flex of back knee; and (d) 90% of body weight on the back leg. This is maintained in hold for 1-2 seconds while avoiding backward sway.

Downswing—In the downswing, the user will always start from a neutral address position (i.e., the position shown in FIG. 27E described below with reference to Phase V) and rotate forward. When the user feels comfortable with starting from the neutral address position, then the user should position himself or herself to the top of the golf swing (i.e., the position corresponding to the top of the backswing shown in FIG. 27B as described below with reference to Phase V). From the top of the golf swing, the user starts the downswing and rotates completely around the spinal axis to a full downswing and follows through. This procedure should be performed in all phases of the downswing. Initially 100% of the user's weight is transferred to the front leg at the beginning of the downswing. The user's head must stay back as it is very important that the head does not slide forward. The pelvis rotates forward, and the spine angle is maintained throughout the swing until 75% completed, while avoiding forward sway. At the finish of the swing, 90% of the weight is placed on the user's front foot and the user should remain balanced in this position for 1-2 seconds. The frequency for each of the foregoing backswing and the downswing exercises is three (3) sets of 10-15 repetitions each.

Phase II

Phase II of the program is the same as described above for Phase I, except that the backswing and downswing exercises are performed while the golf device 10 is connected to the resistance device 16 (i.e., the connecting clip 35 of the elastic band 34 is clipped to one of the connectors 32 of the golf device 10 and the elastic band 34 is connected to the fixed structure A via the strap member 37).

Phase III

Phase III of the program is the same as described above for Phase I but with the following modifications. The backswing exercise is the same, except that the front foot is lifted off the ground at one-half to three-quarter of the way through the backswing to place all the weight on the back foot and stand only on the back foot at the end of the backswing, and this position is maintained for 1-2 seconds. The downswing exercise is also the same, except that at one-half to three-quarter of the way through the downswing the user lifts the back foot to place all of the body weight on the front foot and follows through to complete the swing, holding this position for 1-2 seconds. As described above for Phase I, the user's head must stay back during the downswing as it is very important that the head does not slide forward. The backswing and downswing exercises in this phase function specifically to strengthen the back foot and the front foot, respectively, of the user.

Phase IV

Phase IV entails performing one-foot backswing and downswing exercises. The golf device 10 is not connected to the resistance device 16 for this phase of the program.

Backswing—The user starts by standing on the back leg only and lifting the front leg off the ground, maintaining posture, spine angle, flex back leg, balance and no back sway. Then the user rotates in plane completely standing only on the back foot, holding this position at end of the backswing for 1-2 seconds.

Downswing—The user starts by standing on the front foot only and lifting the back leg of the ground while maintaining posture, spine angle, and no forward sway, and ensuring that the head stays back. The user then rotates completely on the downswing and follows through completely, holding position for 1-2 seconds.

Each of the backswing and downswing exercises in phase IV is performed in three (3) sets of 10-15 repetitions each.

Phase V

Phase V of the program will now be described with reference to FIGS. 27A-27H. Phase V implements the backswing and downswing exercises with step off as described above for Phase III and further with the modifications described below. During the backswing and downswing exercises of Phase V, the golf device 10 is attached to the elastic resistance band 34 which is anchored to a fixed surface A via the strap member 37 (see FIG. 1, for example).

FIGS. 27A-27D illustrate the backswing exercise with step off. The user B initially positions in front of the laser light reflective strip 12 and places the golf device 10 on the upper back (i.e., on the thoracic spine, not on the neck), followed by assuming the specific posture described above with reference to Phase I (FIG. 27A). The user B then rotates completely around the spine axis to a full backswing (FIG. 27B) while avoiding back sway and maintaining (a) spine angle, (b) a plane such that the laser beam 52*a* from the laser device 14 moves in a straight line C along the surface of the laser light reflective strip 12, (c) flex of back knee, and (d) 90% of body weight on the back leg as denoted by arrow A1. One-half to three-quarter of the way through the backswing, the front foot is lifted off the ground, as denoted by arrow A3, to place all (100%) of the weight on the back foot as denoted by arrow A2 (FIG. 27C) and stand only on the back foot at the end of the backswing (FIG. 27D), and this position is maintained for 1-2 seconds. This backswing exercise in Phase V is performed in three (3) sets of 10 repetitions each.

FIGS. 27E to 27H illustrate the downswing exercise with step off. The user B initially positions in front of the laser light reflective strip 12 and places the golf device 10 on the upper back (i.e., on the thoracic spine, not on the neck), followed by assuming the specific posture described above with reference to Phase I (FIG. 27E). The user then begins to rotate completely around the spinal axis towards a full downswing (FIG. 27F) with 50% of the body weight being placed on each leg as denoted by arrows A5 and A6. One-half to three-quarter of the way through the downswing, the back leg is lifted to place all (100%) of the body weight on the front foot as denoted by arrow A7 (FIG. 2G), and the user then follows through to complete the downswing while maintaining all of the body weight on the front foot as denoted by arrow A8 (FIG. 27H), and this position is maintained for 1-2 seconds. This downswing exercise in Phase V is performed in three (3) sets of 10 repetitions each.

Phase VI

Phase VI of the program is the same as described above for Phase IV (one foot backswing and downswing), except that the backswing and downswing exercises are performed while the golf device 10 is connected to the resistance device 16 (i.e., the connecting clip 35 of the elastic band 34 is clipped to one of the connectors 32 of the golf device 10 and the elastic band 34 is connected to the fixed structure A via the strap member 37).

Phase VII-Phase XII

Phases VII through XII are the same as set forth above for Phases I through VI, respectively, except that Phases VII through XII are performed using the rocking board 120 (FIGS. 18A-18C) with the user's foot parallel to the motion of the rocker board (i.e., in the sagital plane). This exercise is repeated with the wobble board 130 (FIGS. 19A-19C).

Phase XIII-Phase XVIII

Phases XIII through XVIII are the same as set forth above for Phases VII through XII, respectively, except that Phases XIII through XVIII are performed using the rocking board 120 (FIGS. 18A-18C) with the user's foot perpendicular to the rocker board motion (i.e., in the coronal plane). This exercise is repeated with the wobble board 130 (FIGS. 19A-19C).

Phase XVIV-Phase XXIV

Phases XVIV through XXIV are the same as set forth above for Phases I through VI, respectively, except that Phases XVIV through XXIV are performed using two wobble boards 130 (FIGS. 19A-19C).

Each of the foregoing phases of the program must be performed proficiently before moving to the next phase. Additionally, it is recommended that a full golf swing should not be practiced until the first six phases (i.e., Phases I-VI) of the program are completed properly. Otherwise the golfer will compensate and reinforce improper swing patterns.

Having described the foregoing preferred embodiment of a program implementing the golf swing training and exercise system according to the present invention, such is intended to be illustrative and not limiting. It is noted that modifications and variations can be made by persons skilled in the art in light of the above teachings.

It will be appreciated by those skilled in the art that the present invention provides a functional golf training and exercise system, program and method that allow a user to develop a proper golf swing by allowing the user to visualize the mechanics of a proper golf swing. The golf device of the system is placed on the upper back of the user allowing the user to perform the motion of a golf swing while removing the over activity of the arms and hands, and facilitating and strengthening the core, leg, hip and back muscles used in the golf swing.

The 24-phase program performed using the golf swing training and exercise system of the present invention provides a quick, complete and easy to use progressive program that corrects various flaws, as described above, in a golf swing, including (1) reverse pivot, (2) swaying of hips/pelvis backward and forward during the backswing and downswing, respectively, (3) swaying forward at ball contact, (4) too much weight on the back foot at ball contact, (5) overuse of arms during the swing caused by lack of rotation of the torso/shoulders, (6) not shifting 110% of the golfer's dynamic body weight to the front foot on the start of the down swing, (7) losing spine angle during the swing, (8) out of plane movement during the backswing and downswing, (9) poor balance, (10) not transferring 90% of the body weight on the front foot at the finish of the golf swing, and (11) poor tempo.

The projection of a laser beam by the laser device along a straight line on the laser light reflective strip during a golf swing training and exercise routine ensures that the user will maintain proper posture and plane throughout the exercise. For example, during a swing training and exercise routine as described herein, out of plane movement during the backswing and downswing is corrected by maintaining the laser light on a proper straight line on the straight laser light reflective strip which will give immediate feedback to the brain ensuring proper plane throughout the swing. Thus, one important feature of the golf swing training and exercise system according to the present invention is the combination of the laser light reflective strip, the laser devices, and the manner of attaching the laser devices to the golf device described above, which function to provide a visual representation of a swing path of a club to assist the user in perfecting his or her swing. Furthermore, the use of a green laser in the laser devices provides a high density energy light source that is highly stable and visible on the laser light reflective surface during the golf swing training and exercise routine.

Another important feature is the provision of the laser device timer which shuts off the laser diode of the laser device automatically at a preselected period of time after the laser diode is activated. This feature conserves energy by increasing the life of the batteries that provide a source of power for the laser diode by ensuring that the laser devices will shut down during periods of non-use of the golf swing training and exercise system.

Another important feature of the golf swing training and exercise system according to the present invention is the provision of the resistance device, as described herein, which provides resistance in the direction of movement of the golf device during a golf swing training and exercise routine. Such exercises performed using the golf swing training and exercise system according to the present invention strengthens and coordinates and facilitates use of the muscles during a golf swing efficiently while increasing balance and proprioception. Accordingly, proper swing dynamics are instilled.

Still another important feature of the present invention relates to the various structures of the golf device described herein, each providing a golf device design that is ergonomic and light, and therefore comfortable and easy to use during a golf training and exercise routine. Additionally, the structural design of the golf device according to the present invention assists the user in learning the proper use of the hands and wrists during a golf swing.

Moreover, the golf swing training/exercising system according to the present invention is portable and suitable for golfers of all sizes, ages, right-handed or left-handed, and both genders. The golf swing training and exercise system is rugged, economical to manufacture, and simple to use both indoors and outdoors.

The golf swing training and exercise system according to the present invention may be provided in the form of a kit containing the elements described herein, including at least the golf device, the laser devices, the optically reflective device, and the resistance device. The kit may also include material (e.g., a poster and a video) that educate and inform the user step-by-step through the assembly/disassembly of the golf swing training and exercise system and each phase of the program described herein.

Moreover, while the embodiments of the golf swing training and exercise system of the present invention have been shown and described in detail herein, those skilled in the art can readily device many other varied embodiments that still incorporate these teachings.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

I claim:

1. A golf swing training and exercise system comprising:

an optically reflective member having an optically reflective surface;

a golf device having a plurality of sections comprised of a center section that is placed on the back of a user during a golf swing training and exercise routine, two end sections extending outwardly from the center section, and a pair of intermediate sections that are disposed between and interconnect the center section and the respective end sections to one another and on which the user's hands or forearms are placed during a golf swing training and exercise routine;

a pair of light source devices that are connected to respective distal ends of the end sections and that project respective light beams on the reflective surface of the optically reflective member during a golf swing training and exercise routine; and a resistance device that connects to the golf device to generate resistance in at least one direction of movement of the golf device during a golf swing training and exercise routine.

2. A golf swing training and exercise system according to claim 1; wherein the resistance device comprises an elastic band having a first end for removable connection to the golf device and a second end opposite the first end for removable connection to a fixed structure.

3. A golf swing training and exercise system according to claim 2; wherein the golf device has at least one connector integral with one of the end sections for connection to the first end of the elastic band during a golf swing training and exercise routine.

4. A golf swing training and exercise system according to claim 2; further comprising a strap member having a first end for removable connection to the second end of the elastic band and a second end for removable attachment to a fixed structure during a golf swing training and exercise routine.

5. A golf swing training and exercise system according to claim 1; wherein each of the light source devices comprises a laser diode that emits laser light.

6. A golf swing training and exercise system according to claim 5; wherein the optically reflective member comprises a linear strip of laser light reflective material.

7. A golf swing training and exercise system according to claim 5; wherein each of the laser diodes comprises a green laser diode.

8. A golf swing training and exercise system according to claim 1; wherein each of the light source devices has a time control circuit that, upon activation of the time control circuit, automatically switches the light source device to an OFF state after a preselected period of time from the time of activation.

9. A golf swing training and exercise system according to claim 1; wherein the sections of the golf device form a single-piece, unitary structure made from a single piece of material.

10. A golf swing training and exercise system according to claim 1; wherein the sections of the golf device form a multi-piece structure comprised of the central section, a first unitary component separate and independent from the central section and including one of the end sections and one of the pair of intermediate sections, and a second unitary component separate and independent from the central section and the first unitary component and including the other of the end sections and the other of the pair of intermediate sections.

11. A golf swing training and exercise system according to claim 1; further comprising a balancing device that supports the user via one or both of the user's legs during a golf swing training and exercise routine.

12. A golf swing training and exercise system according to claim 1; further comprising at least one stabilizing member removably mounted on the central section of the golf device to maintain the golf device generally perpendicular to the user's spine during a golf swing training and exercise routine.

13. A golf swing training and exercise system comprising:

a golf device having a plurality of sections comprised of a center section that is placed on the back of a user during a golf swing training and exercise routine, two end sections extending from respective opposite ends of the center section, and a pair of intermediate sections that are disposed between and interconnect the center section and the respective end sections and on which the user's hands or forearms are placed during a golf swing training and exercise routine;

a pair of light source devices that are connected to respective distal ends of the end sections and that project respective light beams on a reflective surface during a golf swing training and exercise routine; and a resistance device that connects to the golf device to generate resistance in at least one direction of movement of the golf device during a golf swing training and exercise routine.

14. A golf swing training and exercise device according to claim 13; wherein each of the light source devices comprises a laser diode that emits laser light.

15. A golf swing training and exercise device according to claim 13; wherein each of the light source devices has a time control circuit that, upon activation of the time control circuit, automatically switches the light source device to an OFF state after a preselected period of time from the time of activation.

16. A golf swing training and exercise device according to claim 13; wherein the sections of the golf device form a single-piece, unitary structure made from a single piece of material.

17. A golf swing training and exercise device according to claim 13; wherein the sections of the golf device form a multi-piece structure comprised of the central section, a first unitary component separate and independent from the central section and including one of the end sections and one of the pair of intermediate sections, and a second unitary component separate and independent from the central section and the first unitary component and including the other of the end sections and the other of the pair of intermediate sections.

18. A golf swing training and exercise system according to claim 13; wherein the resistance device comprises an elastic resistance band that connects at one end to one of the end sections of the golf device and at another end to a fixed structure during a golf swing training and exercise routine.

19. A golf swing training and exercise kit comprising:

means defining a laser light reflective surface;

a golf device having a plurality separate and independent sections including a pair of side sections and a center section for removable connection between the side sections to form a golf swing training and exercise device that is used by a golfer during a golf swing training and exercise routine by placing the user's hands or forearms on the side sections and placing the center section in contact with the user's upper back;

a pair of laser devices mounted on the golf swing training and exercise device to project laser light onto the laser light reflective surface by movement of the golf swing training and exercise device during the golf swing training and exercise routine; and a resistance device that connects to the golf device to generate resistance in at least one direction of movement of the golf device during a golf swing training and exercise routine.

20. A golf swing training and exercise kit according to claim 19; wherein each laser device has a time control circuit which, upon activation, automatically switches the laser device from an ON state to an OFF state after a preselected period of time from the time of activation.

21. A golf swing training and exercise kit according to claim 19; wherein each laser device comprises a green laser diode.

22. A golf swing training and exercise kit according to claim 19; wherein the resistance device comprises an elastic resistance band that connects at one end to one of the end sections of the golf device and at another end to a fixed structure during a golf swing training and exercise routine.

* * * * *